US006531994B1

(12) United States Patent
Nagano

(10) Patent No.: US 6,531,994 B1
(45) Date of Patent: Mar. 11, 2003

(54) METHOD OF DRIVING AC-TYPE PLASMA DISPLAY PANEL AND PLASMA DISPLAY DEVICE

(75) Inventor: Shinichiro Nagano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 92 days.

(21) Appl. No.: 09/635,709

(22) Filed: Aug. 9, 2000

(30) Foreign Application Priority Data

Nov. 18, 1999 (JP) ..... 11-328343

(51) Int. Cl.[7] ..... G09G 3/28
(52) U.S. Cl. ..... 345/60; 345/66; 345/67
(58) Field of Search ..... 345/60, 62, 63, 345/66, 67, 68, 71, 78; 313/582, 583, 584, 585, 586, 587

(56) References Cited

U.S. PATENT DOCUMENTS

| | | | | |
|---|---|---|---|---|
| 6,031,329 | A | | 2/2000 | Nagano |
| 6,072,449 | A | | 6/2000 | Amemiya |
| 6,124,849 | A | * | 9/2000 | Ito et al. ..... 345/204 |
| 6,127,992 | A | | 10/2000 | Sano ..... 345/60 |
| 6,137,226 | A | | 10/2000 | Nagano |
| 6,144,348 | A | * | 11/2000 | Kanazawa et al. ..... 345/60 |
| 6,208,082 | B1 | | 3/2001 | Kim et al. |
| 6,313,580 | B1 | * | 11/2001 | Makino ..... 313/582 |
| 6,084,558 | A1 | | 7/2002 | Setoguchi et al. |
| 2002/0008474 | A1 | | 1/2002 | Kurogi et al. |

FOREIGN PATENT DOCUMENTS

| | | |
|---|---|---|
| EP | 0 762 373 A2 | 3/1997 |
| EP | 0 959 450 A1 | 11/1999 |
| JP | 2-220330 | 9/1990 |
| JP | 3-125187 | 5/1991 |
| JP | 4-29293 | 1/1992 |
| JP | 5-2993 | 1/1993 |
| JP | 6-289809 | 10/1994 |
| JP | 2666711 | 6/1997 |
| JP | 9-160525 | 6/1997 |
| JP | 9-244573 | 9/1997 |
| JP | 10-247072 | 9/1998 |
| JP | 11-272232 | 10/1999 |
| JP | 11-327503 | 11/1999 |
| JP | 11-327505 | 11/1999 |
| JP | 2000-39866 | 2/2000 |
| JP | 2000-39867 | 2/2000 |
| JP | 2000-113828 | 4/2000 |
| JP | 2000-181402 | 6/2000 |
| JP | 2001-15034 | 1/2001 |

* cited by examiner

*Primary Examiner*—Dennis-Doon Chow
(74) *Attorney, Agent, or Firm*—Birch, Stewart, Kolasch & Birch, LLP

(57) ABSTRACT

An AC-type PDP in which adjacent two scanning lines share one sustain discharge electrode and a discharge separator for separating surface discharges in the adjacent scanning lines is driven as follows. In a writing period (O4), the voltages at odd-numbered sustain discharge electrodes ($J_{2n-1}$) are set to the voltage (H) and the voltages at even-numbered sustain discharge electrodes ($J_{2n}$) are set to the voltage (M). At selection of odd-numbered scanning lines ($S_{2n-1}$) in descending order, when image data (W) according to the scanning line ($S_{2n-1}$) is applied to an address electrode (22), the voltages at the sustain discharge electrodes ($J_{2n+1}$ and $J_{2n}$) are changed to the voltages (M and L), respectively. In a polarity reverse period (RV), after a voltage (Voff) is applied to all the address electrodes (22) and the voltages at the sustain discharge electrodes ($J_{2n-1}$ and $J_{2n}$) are changed from the voltage (M) to the voltages (L and H), respectively, the voltages at the sustain discharge electrodes ($J_{2n-1}$ and $J_{2n}$) are returned to the voltage (M). In a writing period (E4), even-numbered scanning lines ($S_{2n}$) are selected in ascending order conversely to the order in the writing period (O4). With this operation, it is possible to enhance a display contrast, reduce a reactive power and stabilize a writing discharge.

13 Claims, 19 Drawing Sheets

METHOD OF DRIVING AC-TYPE PLASMA DISPLAY PANEL AND PLASMA DISPLAY DEVICE

BACKGROUND OF THE INVENTION

1. Field of the Invention

The present invention relates to a method of driving an AC-type plasma display panel (hereinafter, also referred to as "AC-type PDP") in which adjacent two scanning lines share one sustain discharge electrode and a discharge separator for separating surface discharges in discharge cells of the adjacent scanning lines is provided, and a plasma display device which drives the AC-type PDP by using the driving method.

2. Description of the Background Art

An AC-type PDP having a structure in which adjacent two scanning lines share one sustain discharge electrode is well known. The AC-type PDP having such a structure is disclosed in Japanese Patent Application Laid Open Nos. 2-220330 (1990), 6-289809 (1994) and the like. In such an AC-type PDP, when there are 2N scanning lines, only (2N+1) sustain discharge electrodes are needed.

In general, each sustain discharge electrode includes a transparent electrode and a bus electrode. The transparent electrode has a strip-like shape and the bus electrode is provided on the transparent electrode along a central axis in a width direction of the transparent electrode.

A front substrate and a rear substrate of the AC-type PDP are provided face to face with each other with a plurality of stripe-shaped barrier ribs (also simply referred to as "ribs") extending in a direction of intersecting the sustain discharge electrodes interposed therebetween. In this case, the discharge cells are defined by the barrier ribs in a longitudinal direction of the sustain discharge electrode, i.e., a direction of intersecting the scanning lines.

As discussed above, in the AC-type PDP of the background art, adjacent two scanning lines share one sustain discharge electrode. Therefore, if there is no structure to separate a surface discharge between two sustain discharge electrodes defining one scanning line from a surface discharge in the adjacent scanning line, the surface discharge generated in the discharge cell belonging to one of the scanning lines has an effect on the other scanning line. For example, a discharge cell which should not be illuminated is illuminated.

SUMMARY OF THE INVENTION

The present invention is directed to a method of driving an AC-type plasma display panel. According to a first aspect of the present invention, in the method of driving an AC-type plasma display panel, the AC-type plasma display panel comprises: a first substrate including a plurality of sustain discharge electrodes extending in parallel with one another, between adjacent two of which each of a plurality of scanning lines is defined, each of the sustain discharge electrodes is shared by adjacent two of the scanning lines, and a dielectric layer covering the sustain discharge electrodes, the dielectric layer having a main surface on which surface discharges are generated, the surface discharges illuminating discharge cells belonging to each of the scanning lines; a second substrate provided on a side of the main surface of the dielectric layer face to face with the first substrate, the second substrate including a plurality of address electrodes provided in a direction to intersect the sustain discharge electrodes, the address electrodes extending in parallel with one another; a plurality of barrier ribs provided between the first and second substrates, in parallel with the address electrodes; and a discharge separator provided on a boundary of the adjacent two scanning lines, for separating the surface discharges in the discharge cells belonging to the adjacent two scanning lines, and in the method of the first aspect, one screen is divided into a plurality of sub-fields, each of the plurality of sub-fields including a reset period for erasing electric charges accumulated in the discharge cells; a writing period for performing sequentially a selection of the scanning lines by applying scanning-line selection voltages of different values to adjacent two of the sustain discharge electrodes to scan the scanning lines and performing a writing operation in synchronization with the selection of the scanning lines, in which voltages according to ON/OFF states of image data of a selected scanning line are applied to the address electrodes, to generate a writing discharge in the discharge cell belonging to the address electrode to which the voltage corresponding to the ON state is applied; and a sustain period for performing a discharge sustain operation in which a sustain voltage is applied to the sustain discharge electrodes, to generate the surface discharge in the discharge cell in which the writing discharge is generated, and the electric charges are erased enough in all of the discharge cells belonging to the adjacent two scanning lines in the reset period, the scanning lines are divided into a plurality of groups and the writing operation is performed on a group-by-group basis in the writing period, and the discharge sustain operation is performed on all of the discharge cells belonging to the adjacent two scanning lines in the sustain period.

According to a second aspect of the present invention, in the method of driving an AC-type plasma display panel according to the first aspect, assuming that one of the sustain discharge electrodes shared by the adjacent two scanning lines is a first sustain discharge electrode, one of the sustain discharge electrodes defining one of the adjacent two scanning lines with the first sustain discharge electrode is a second sustain discharge electrode and one of the sustain discharge electrodes defining the other of the adjacent two scanning lines with the first sustain discharge electrode is a third sustain discharge electrode, a potential difference of the second sustain discharge electrode to the first sustain discharge electrode at selection of the one of the adjacent two scanning lines and a potential difference of the third sustain discharge electrode to the first sustain discharge electrode at selection of the other of the adjacent two scanning lines are made reverse in polarity to each other.

According to a third aspect of the present invention, in the method of driving an AC-type plasma display panel according to the first or second aspect, a discharge inhibition voltage for inhibiting generation of the writing discharge is applied to at least one of the two sustain discharge electrodes defining the scanning line when the corresponding scanning line is not selected in the writing period.

According to a fourth aspect of the present invention, in the method of driving an AC-type plasma display panel according to the third aspect, the scanning-line selection voltage is applied to the other of the two sustain discharge electrodes during a period from the start of the scanning on the group to which the corresponding scanning line belongs to at least the end of the selection of the corresponding scanning lines.

According to a fifth aspect of the present invention, in the method of driving an AC-type plasma display panel according to the third or fourth aspect, the scanning lines are divided into the groups so that the scanning lines belonging to the same group are not adjacent to one another, and the discharge inhibition voltage is applied to the sustain discharge electrode defining the scanning line, belonging to the groups not to be scanned, which is adjacent to the other of the two sustain discharge electrodes, during the scanning on the group to be scanned.

According to a sixth aspect of the present invention, in the method of driving an AC-type plasma display panel according to the fifth aspect, the scanning-line selection voltage is continuously applied to the other of the two sustain discharge electrodes during the scanning.

According to a seventh aspect of the present invention, in the method of driving an AC-type plasma display panel according to any one of the first to sixth aspects, the polarity of electric charges is reversed, the electric charges being produced by the writing discharge and accumulated above each of the sustain discharge electrodes of the discharge cells belonging to one of the adjacent two scanning lines, in which the writing discharge is generated, and the other of the adjacent two scanning lines is thereafter selected.

According to an eighth aspect of the present invention, in the method of driving an AC-type plasma display panel according to any one of the first to sixth aspects, a voltage applied to the sustain discharge electrodes is not changed from the end of the scanning on one of the groups when the scanning on others of the groups starts.

According to a ninth aspect of the present invention, in the method of driving an AC-type plasma display panel according to any one of the first to eighth aspects, a voltage applied to the sustain discharge electrodes is not changed from the end of the writing period when the discharge sustain operation in the sustain period starts.

According to a tenth aspect of the present invention, in the method of driving an AC-type plasma display panel according to any one of the first to ninth aspects, the order of execution of the writing operation in the groups is not the same through a plurality of screens.

According to an eleventh aspect of the present invention, in the method of driving an AC-type plasma display panel according to any one of the first to tenth aspects, the scanning lines are divided into two regions in a direction of arrangement and each of the address electrodes consists of two electrodes which belongs to the two regions, respectively, being electrically separated in the AC-type plasma display panel, and the scanning lines belonging to each of the regions are divided into a plurality of groups and the writing operation is performed on a group-by-group basis, and the selection of two of the scanning lines adjacent to each other with a boundary of the two regions interposed therebetween is performed in synchronization in the writing period.

The present invention is also directed to an AC-type plasma display device. According to a twelfth aspect of the present invention, the plasma display device comprises: an AC-type plasma display panel; and a driving device for driving the AC-type plasma display panel, wherein the AC-type plasma display panel comprises a first substrate including a plurality of sustain discharge electrodes extending in parallel with one another, between adjacent two of which each of a plurality of scanning lines is defined, each of the sustain discharge electrodes is shared by adjacent two of the scanning lines, and a dielectric layer covering the sustain discharge electrodes, the dielectric layer having a main surface on which surface discharges are generated, the surface discharges illuminating discharge cells belonging to each of the scanning lines; a second substrate provided on a side of the main surface of the dielectric layer face to face with the first substrate, the second substrate including a plurality of address electrodes provided in a direction to intersect the sustain discharge electrodes, the address electrodes extending in parallel with one another; a plurality of barrier ribs provided between the first and second substrates, in parallel with the address electrodes; and a discharge separator provided on a boundary of the adjacent two scanning lines, for separating the surface discharges in the discharge cells belonging to the adjacent two scanning lines, and in the plasma display device of the twelfth aspect, the driving device drives the AC-type plasma display panel with one screen divided into a plurality of sub-fields, each of the sub-fields including a reset period for erasing electric charges accumulated in the discharge cells; a writing period for performing sequentially a selection of the scanning lines by applying scanning-line selection voltages of different values to adjacent two of the sustain discharge electrodes to scan the scanning lines and performing a writing operation in synchronization with the selection of the scanning lines, in which voltages according to ON/OFF states of image data of a selected scanning line are applied to the address electrodes, to generate a writing discharge in the discharge cell belonging to the address electrode to which the voltage corresponding to ON state is applied; and a sustain period for performing a discharge sustain operation in which a sustain voltage is applied to the sustain discharge electrodes, to generate the surface discharge in the discharge cell in which the writing discharge is generated, and the driving device erases enough the electric charges in all of the discharge cells belonging to the adjacent two scanning lines in the reset period, divides the scanning lines into a plurality of groups and performs the writing operation on a group-by-group basis in the writing period, and performs the discharge sustain operation on all of the discharge cells belonging to the adjacent two scanning lines in the sustain period.

(1) In the driving method of the first aspect of the present invention, in each sub-field, predetermined operations are performed on all the discharge cells in the reset period and the sustain period. In other words, the reset period and the sustain period are not provided for each writing operation of the scanning lines on a group-by-group basis. Therefore, it is possible to remarkably reduce the time required for the reset period and sustain period for one sub-field as compared with a case where the reset period and sustain period are provided for the writing operation performed on a group-by-group basis. Accordingly, by assigning the reduced time to the writing period, it is possible to generate the writing discharge with more stability and more reliability.

Further, since the erase operation is performed on all the discharge cells in the reset period, only one reset period is provided for one sub-field. Therefore, it is possible to reduce the dark luminance (background luminance) and enhance the display contrast as compared with a case where the reset period is provided for the writing operation performed on a group-by-group basis.

Furthermore, since the discharge sustain operation is performed on all the discharge cells in the sustain period, only one sustain period is provided for one sub-field. Therefore, it is possible to remarkably reduce the reactive power in the whole sustain period as compared with a case where the sustain period is provided for the writing operation performed on a group-by-group basis.

(2) In the driving method of the second aspect of the present invention, when one or the other of the scanning lines sharing one sustain discharge electrode is first selected, even if an opposite discharge (unnecessary opposite discharge) is generated between the sustain discharge electrode and the address electrode in the discharge cell belonging to the scanning line not to be selected, the writing discharge can be reliably generated at the selection of the scanning line not to be selected.

Further, in the process of selection of one or the other of the scanning lines sharing one sustain discharge electrode, the polarities of the voltages working between the one sustain discharge electrode and its adjacent sustain discharge electrode can be made reverse to each other. Therefore, it is possible to suppress migration between the adjacent sustain discharge electrodes through the whole writing period.

(3) In the driving method of the third aspect of the present invention, since the discharge inhibition voltage is applied to at least one of the two sustain discharge electrodes defining the scanning line when the scanning line is not selected, the writing discharge (and even the opposite discharge (unnecessary opposite discharge and unintentional opposite discharge) between the address electrode and the sustain discharge electrode, which induces the writing discharge) is not unintentionally generated. Therefore, it is possible to inhibit the normal writing discharge from being impeded by the electric charges generated and accumulated by the unintentional writing discharge and the normal (wall) charges accumulated after the normal writing discharge from being reduced by the unintentional writing discharge. As a result, disadvantages such as not-lighting in the sustain period are solved and an image display of higher quality can be achieved.

(4) In the driving method of the fourth aspect of the present invention, since the scanning-line selection voltage is applied to the other of the sustain discharge electrodes defining the scanning line at the selection of the scanning line, the scanning line can be selected only by switching the voltage applied to the one of the sustain discharge electrodes from the discharge inhibition voltage to the scanning-line selection voltage. Therefore, it is possible to speed up the response of generation of the writing discharge and generate the writing discharge with more reliability as compared with a case where the voltages applied to both the one and the other of the sustain discharge electrodes are switched to the scanning-line selection voltage. Further, the driving sequence of the circuit for supplying the sustain discharge electrode with the voltage is simplified and the load on the circuit can be reduced.

(5) In the driving method of the fifth aspect of the present invention, the discharge inhibition voltage is applied to the sustain discharge electrode defining the scanning line belonging to the group not to be scanned and being adjacent to the other of sustain discharge electrodes during the scanning of the group to be scanned. On the other hand, the discharge inhibition voltage is applied to the one of the sustain discharge electrodes when the scanning line is not selected during the scanning. In other words, the other of the sustain discharge electrodes is sandwiched by the sustain discharge electrodes to which the discharge inhibition voltage is applied other than when the scanning line is selected. Therefore, even if the scanning-line selection voltage is continuously applied during the scanning of the other of the sustain discharge electrodes, no unintentional writing discharge is generated in the discharge cells belonging to the scanning lines sharing the other of the sustain discharge electrodes. Accordingly, by setting the voltage applied to the other of the sustain discharge electrodes as above, the necessity of switching the voltage applied to the other of the sustain discharge electrodes is eliminated during the scanning. As a result, the driving sequence of the circuit for supplying the sustain discharge electrode with the voltage is simplified and the load on the circuit can be reduced as compared with the driving method of the fourth aspect.

(6) In the driving method of the sixth aspect of the present invention, it is not necessary to switch the voltage applied to the other of the sustain discharge electrodes during the scanning. Therefore, the driving sequence of the circuit for supplying the sustain discharge electrode with the voltage is simplified and the load on the circuit can be reduced as compared with the driving method of the fifth aspect.

(7) In the driving method of the seventh aspect of the present invention, after reversing the polarity of the electric charges generated and accumulated above the sustain discharge electrodes defining one of the adjacent two scanning lines by the writing discharge, the other scanning line is selected. Therefore, it is possible to remarkably suppress generation of the discharges in the discharge cells after the writing operation by superimposing the predetermined voltages applied to the sustain discharge electrodes at the selection of the other of the two adjacent scanning lines: on the voltage by the normal electric charges accumulated in the discharge cells in which the writing discharge is generated, belonging to the one of the scanning lines. Accordingly, it is possible to reliably inhibit the writing discharge (unintentional writing discharge) which is unintentionally generated in the discharge cells belonging to the other of the scanning lines by the priming effect of the discharge. As a result, disadvantages such as not-lighting are solved and an image display of higher quality can be achieved as compared with a case where the polarity reverse is not made.

(8) In the driving method of the eighth aspect of the present invention, it is possible to reduce the number of switching operations for the voltage applied to the sustain discharge electrode as compared with a case where the voltage applied to the sustain discharge electrode is set to the predetermined initial value every time before the start of scanning the groups. Therefore, the driving sequence of the circuit for supplying the sustain discharge electrode with the voltage is simplified and the load on the circuit can be reduced.

(9) In the driving method of the ninth aspect of the present invention, it is possible to reduce the number of switching operations for the voltage applied to the sustain discharge electrode as compared with a case where the voltage applied to the sustain discharge electrode is set to the predetermined initial value before the start of the sustain period. Therefore, the driving sequence of the circuit for supplying the sustain discharge electrode with the voltage is simplified and the load on the circuit can be reduced.

(10) In the driving method of the tenth aspect of the present invention, it is possible to inhibit the instability of display which may be caused in a case where the order of performing the writing operation in a plurality of groups is the same through a plurality of screens. Further, even if there arises a difference in the number of luminescences or in luminescence intensity among the groups caused by the writing operation performed on a group-by-group basis in the sustain period, the difference in luminescence intensity can be compensated on a macro time-scale to suppress the luminance unevenness of display image. As the result of these functions, an image display of higher quality can be achieved.

(11) In the driving method of the eleventh aspect of the present invention, two scanning lines which are adjacent to each other with the boundary of the two regions interposed therebetween are selected in synchronization with each other. Therefore, it is possible to suppress variation of the state of the electric charges accumulated in the discharge cells, which may be caused in a case where the timings of selecting the two scanning lines are different from each other. This allows the writing operation to be reliably performed in the discharge cells belonging to both. the scanning lines. As a result, the effects of the first aspect (1) to the tenth aspect (10) can be produced also in the AC-type plasma display panel of the eleventh aspect.

(12) In the plasma display device of the twelfth aspect of the present invention, the same effect as that of the first aspect (1) can be produced.

A main object of the present invention is to provide an AC-type PDP in which adjacent two scanning line share one sustain discharge electrode and a discharge separator for separating surface discharges generated in discharge cells of the adjacent scanning lines from each other, and to provide a method of driving the AC-type PDP.

In particular, a first object of the present invention is to provide a method of driving the AC-type PDP having the above structure, which produces effects of enhancing the display contrast, reducing reactive power and stabilizing the writing discharge.

Further, a second object of the present invention is to provide a method of driving the AC-type PDP having the above structure, which produces an effect of achieving an image display of higher quality as well as achieves the first object.

Moreover, a third object of the present invention is to provide a method of driving the AC-type PDP having the above structure, which produces an effect of reducing the load on the circuit for supplying the sustain discharge electrode with a voltage as well as achieves the first object.

Furthermore, a fourth object of the present invention is to provide a method of driving the AC-type PDP having the above structure, which produces an effect of speeding up the response of generation of the writing discharge as well as achieves the third object.

Moreover, a fifth object of the present invention is to provide a method of driving the AC-type PDP having the above structure, which produces an effect of suppressing the migration between adjacent sustain discharge electrodes as well as achieves the first object.

A sixth object of the present invention is to provide a plasma display device which achieves the first to fifth objects.

These and other objects, features, aspects and advantages of the present invention will become more apparent from the following detailed description of the present invention when taken in conjunction with the accompanying drawings.

DESCRIPTION OF THE PREFERRED EMBODIMENTS

<Background Art>

Figure 20:
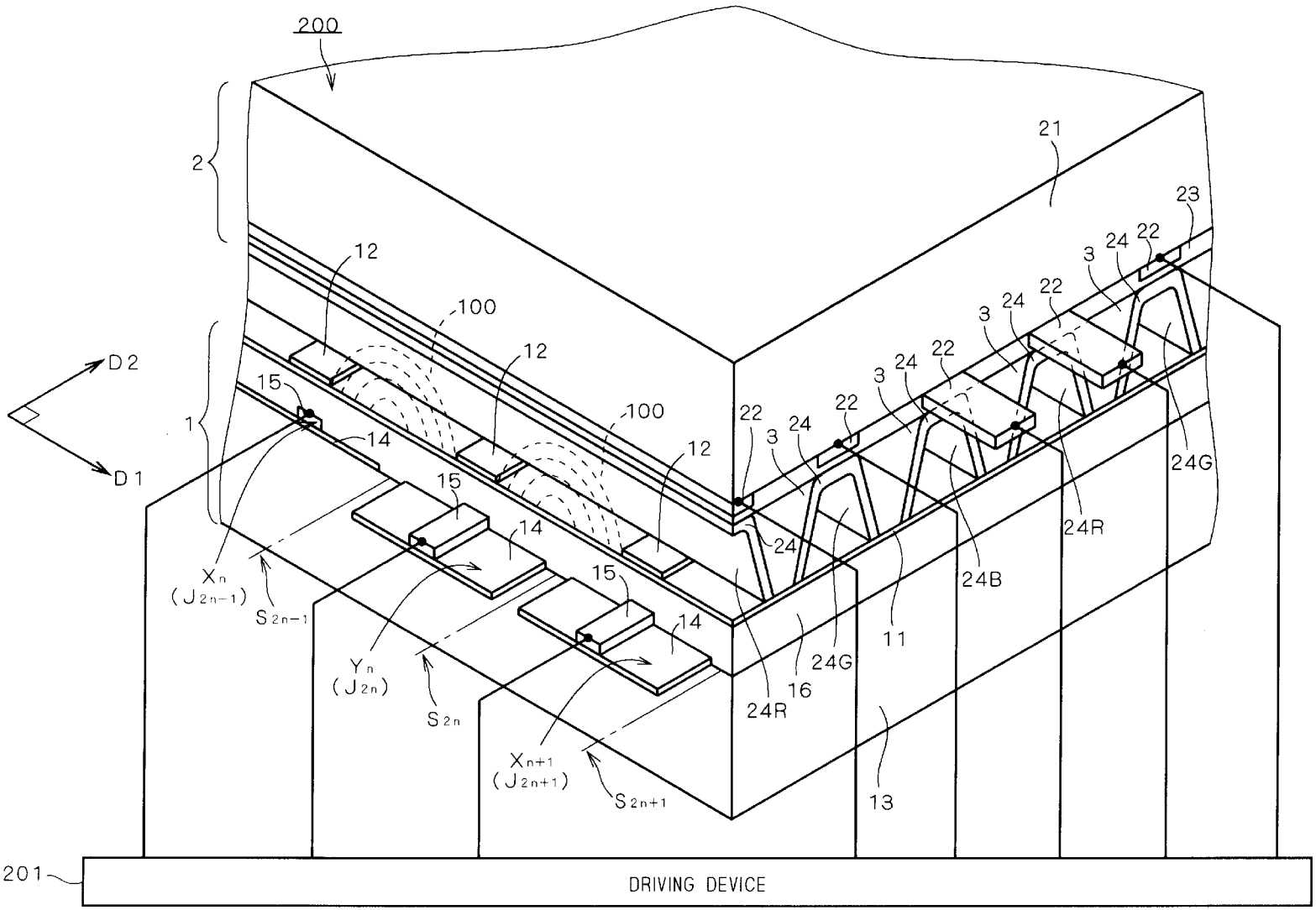
FIG. 20 is a schematic diagram showing a structure of a plasma display device in the background art.

FIG. 20 is a schematic diagram showing a structure of a plasma display device in the background art. The plasma display device comprises an AC-type PDP 200, which is disclosed in Japanese Patent Application Laid-Open No. 2000-39866, and a driving device or a driving circuit 201 for driving the AC-type PDP 200. The AC-type PDP 200 and the driving device 201 will be sequentially discussed below.

As shown in FIG. 20, the AC-type PDP 200 comprises a front substrate or a first substrate 1 being transparent and having a main surface in parallel with a plane having a first direction D1 and a second direction D2 which are perpendicular to each other and a rear substrate or a second substrate 2 having a main surface confronting the main surface of the front substrate 1. The front substrate 1 and the rear substrate 2 are provided face to face with each other with a plurality of stripe-shaped barrier ribs extending in parallel with one another interposed therebetween.

The front substrate 1 comprises a glass substrate 13 and on a surface of the glass substrate 13 on a side of the rear substrate 2 provided are (N+1) sustain discharge electrodes X and N sustain discharge electrodes Y. The sustain discharge electrodes X and the sustain discharge electrodes Y extend along the second direction D2 in parallel with one another. Further, the sustain discharge electrodes X and the sustain discharge electrodes Y are alternately arranged. For distinction, a plurality of sustain discharge electrodes X are referred to as a sustain discharge electrode $X_1$, a sustain discharge electrode $X_2$, . . . , and a sustain discharge electrode $X_{N+1}$ in due order from the upper stage viewed from the AC-type PDP 200 with the second direction D2 as a horizontal direction, and any one of them is referred to as a sustain discharge electrode $X_n$ ($1 \leqq n \leqq N+1$). The same applies to a plurality of sustain discharge electrodes Y, where any one of them is referred to as a sustain discharge electrode $Y_n$ ($1 \leqq n \leqq N$).

In the AC-type PDP 200, a scanning line S is defined by adjacent sustain discharge electrodes X and Y. In detail, an odd-numbered scanning line $S_{2n-1}$, is defined in the gap or space between adjacent sustain discharge electrodes $X_n$ and $Y_n$, and an even-numbered scanning line $S_{2n}$ is defined in the gap between adjacent sustain discharge electrodes $Y_n$ and $X_{n+1}$. Thus, 2N scanning lines are configured in the AC-type PDP 200. In other words, adjacent scanning lines $S_{2n-1}$ and $S_{2n}$ share the sustain discharge electrode $Y_n$ and adjacent scanning lines $S_{2n}$ and $S_{2n+1}$ share the sustain discharge electrode $X_{n+1}$. A predetermined voltage or potential difference is given between the adjacent sustain discharge electrodes X and Y, to generate a surface discharge 100.

Each of the sustain discharge electrodes X and Y includes a transparent electrode 14 and a bus electrode 15. The transparent electrode 14 is a strip-like electrode extending in the second direction D2 and the bus electrode 15 is provided along the central axis in the width direction (the first direction D1) of the transparent electrode 14 on the surface of the transparent electrode 14 on the side of the rear substrate 2. In other words, the bus electrode 15 defines a boundary between adjacent two scanning lines S. The transparent electrode 14 serves to enlarge the surface discharge 100 and the bus electrode 15 serves to reduce resistances of the sustain discharge electrodes X and Y.

Further a dielectric layer 16 is provided to cover the surfaces of the sustain discharge electrodes X and Y and the glass substrate 13, and a cathode film 11 composed of magnesium oxide (MgO) is provided on a surface of the dielectric layer 16 on the side of the rear substrate 2 (covering the sustain discharge electrodes X and Y). Furthermore, the dielectric layer 16 and the cathode film 11 may be referred to as "dielectric layer" as a unit.

In the AC-type PDP 200, particularly, discharge inert films or discharge separators 12 are provided on a surface of the cathode film 11 on the side of the rear substrate 2. In detail, the discharge inert films 12 are provided near a region in which the bus electrodes 15 are projected in the above surface of the cathode film 11 and extend along the second direction D2 in parallel with one another. The discharge inert film 12 is made of materials which are less inert than MgO, in other words, lower in secondary-electron emission ratio than MgO as a discharge material. As the discharge inert film 12, for example, aluminum oxide ($Al_2O_3$), titanium oxide ($TiO_2$) or the like may be used.

On the other hand, the rear substrate 2 comprises a glass substrate 21, and a plurality of address electrodes 22 extending on a surface of the glass substrate 21 on the side of the front substrate 1 along the first direction D1 in parallel with one another. The dielectric layer or an overglaze layer 23 is provided to cover the surfaces of the address electrodes 22 and glass substrate 21.

The barrier rib 3 extends along the first direction D1 near a region on a surface of the overglaze layer 23 on the side of the front substrate 1, in which each gap between adjacent address electrodes 22 is projected. A phosphor layer 24 is formed on a surface of a concave portion or a U-shaped groove defined by the barrier ribs 3 and the overglaze layer 23. Further, in FIG. 20, phosphor layers 24 for red luminescence, green luminescence and blue luminescence are represented by 24R, 24G and 24B.

The front substrate 1 and the rear substrate 2 are bonded with the barrier ribs 3 interposed therebetween, to construct the AC-type PDP 200. Each space surrounded by the main surface of the front substrate 1 and the phosphor layer 24, extending in the first direction D1, forms a discharge space. The discharge space is filled with discharge gas including, for example, neon (Ne) and xenon (Xe).

In the AC-type PDP 200, one discharge cell is defined by intersection of the scanning lines S and the address electrode 22 and the discharge cells are arranged in matrix.

The discharge inert film 12 serves to separate surface discharges 100 between adjacent two scanning lines S. This function will be discussed. As discussed above, in the AC-type PDP 200, adjacent two scanning lines S share one sustain discharge electrode X or sustain discharge electrode Y. Therefore, if there is no discharge inert film 12, exposed portions of the cathode film 11 belonging to the scanning lines S or the discharge cells aligned along the first direction D1 become continuous and as a result, the surface discharges 100 between the sustain discharge electrodes X and Y in the scanning lines S are overlapped. If the surface discharges 100 in the scanning lines S are not separated, (i) surface discharges (sustain discharges) 100 between the adjacent scanning lines S interferes with each other, to make a display unstabilized. Further, if the surface discharges 100 in the scanning lines S are not separated, (ii) since the discharge for one scanning line S is generated with the full width of the sustain discharge electrode X or Y, the size or generation area of the surface discharge for one scanning line S becomes larger than the gap between adjacent two bus electrodes 15, to degrade definition of the display.

Further, if the discharge is generated with full width of each sustain discharge electrode X or Y, the maximum current flowing per a bus electrode 15 becomes larger. As a result, (iii) since the voltage drop in the longitudinal direction (the second direction D2) of the bus electrode 15 becomes larger, the effective voltage of the sustain discharge electrode X or Y with which the discharge cell is supplied becomes lower. At this time, since the voltage drop becomes larger as it goes nearer to the center in the longitudinal direction of the bus electrode 15, the distribution of the effective voltage along the longitudinal direction of the bus electrode 15 becomes pronounced, the size and magnitude of the surface discharge 100 generating the sustain discharge, therefore the luminance of the discharge cell becomes lower in the discharge cell provided nearer to the center in the longitudinal direction. Furthermore, (iv) if the maximum current flowing per a bus electrode 15 becomes larger, the load on elements constituting a circuit (driving device) for supplying the bus electrode 15 and the sustain discharge electrodes X and Y with a voltage becomes larger.

In contrast, since the surface discharges 100 in the adjacent two scanning lines S are separated by the discharge inert film 12 in the AC-type PDP 200, the above problems (i) and (ii) are solved. Further, since the maximum current flowing per a bus electrode 15 can be reduced by not generating any discharge in a region having the discharge inert film 12, the above problems (iii) and (iv) are solved.

Other than the discharge inert film 12, the following structures (a) and (b), for example, can separate the surface discharge between adjacent scanning lines S.

Specifically, (a), providing the barrier ribs 3 of FIG. 20 with extension in the second direction D2 in a lattice manner defines the discharge space between the adjacent scanning lines S. The extension in the second direction D2 may be formed of, for example, the phosphor layer 24, other dielectric material or insulative material. In this case, the extension formed of these materials in the second direction D2 corresponds to the discharge separator.

Alternatively, (b) thickening the dielectric layer 16 near the adjacent scanning lines S to narrow the discharge space. Since this makes it hard to generate the discharge in the narrow discharge space, it becomes possible to separate the surface discharges between the adjacent scanning lines S. In such a case, a portion of the dielectric layer 16 which is thickened near the adjacent scanning lines S corresponds to the discharge separator.

Next, a method of driving the AC-type PDP 200 or a driving sequence will be discussed. In a case of performing a tone display in the AC-type PDP, generally, one screen is divided into a plurality of sub-fields and a predetermined weighting is set to a display luminescence in each sub-field. Then, the sub-fields are selected and combined according to image data or an image signal of each discharge cell. The same driving method can apply to the AC-type PDP 200.

Each sub-field includes a reset period, a writing period and a sustain period or a display period.

In the reset period, an erase discharge is generated in the discharge cell, to erase electric charges or wall charges remaining in the discharge cell at the end of the immediately-preceding sub-field. This resets the image data of the immediately-preceding sub-field, which is stored as the wall charges (erase operation).

In the writing period, the image data of the present sub-field is stored in the discharge cell after the reset period (writing operation). In detail, in the writing period, the scanning lines S are scanned by sequential selection, and in synchronization with this selection and scanning, a voltage Von or Voff according to the ON/OFF state of the image data corresponding to the selected scanning line S is applied to the address electrode 22. In general, the voltages Von and Voff are set as Von>Voff. At this time, by generating a writing discharge in the discharge cell belonging to the address electrode 22 to which the ON-state image data or the voltage Von is applied among the discharge cells belonging to the selected scanning line S, the ON-state image data is written or stored in the discharge cell as wall charges.

In the sustain period, a discharge sustain operation for applying a sustain voltage to the sustain discharge electrodes X and Y is performed, to generate a sustain discharge in the discharge cell in which the wall charges are generated in the writing period.

In the AC-type PDP 200, the sequential selection or scanning of the scanning lines S in the writing period is performed as follows. Specifically, the voltage to be applied to the sustain discharge electrodes X and Y defining the scanning lines S or the polarity of the voltage is controlled to apply a combination of High-level and Low-level voltages (scanning-line selection voltage) to only the sustain discharge electrodes X and Y defining the selected scanning line S. In the following discussion, the High-level and Low-level voltages are also referred to as voltage (value) H and voltage (value) L (<voltage H), respectively.

Next, a method of driving the AC-type PDP 200 by the driving device 201 will be discussed. The driving device 201 is connected to the sustain discharge electrodes X and Y and the address electrodes 22 and supplies the sustain discharge electrodes X and Y and the address electrodes 22 with predetermined voltages by using a kind of driving sequences as discussed later, to drive the discharge cells or the AC-type PDP 200.

Figure 21:
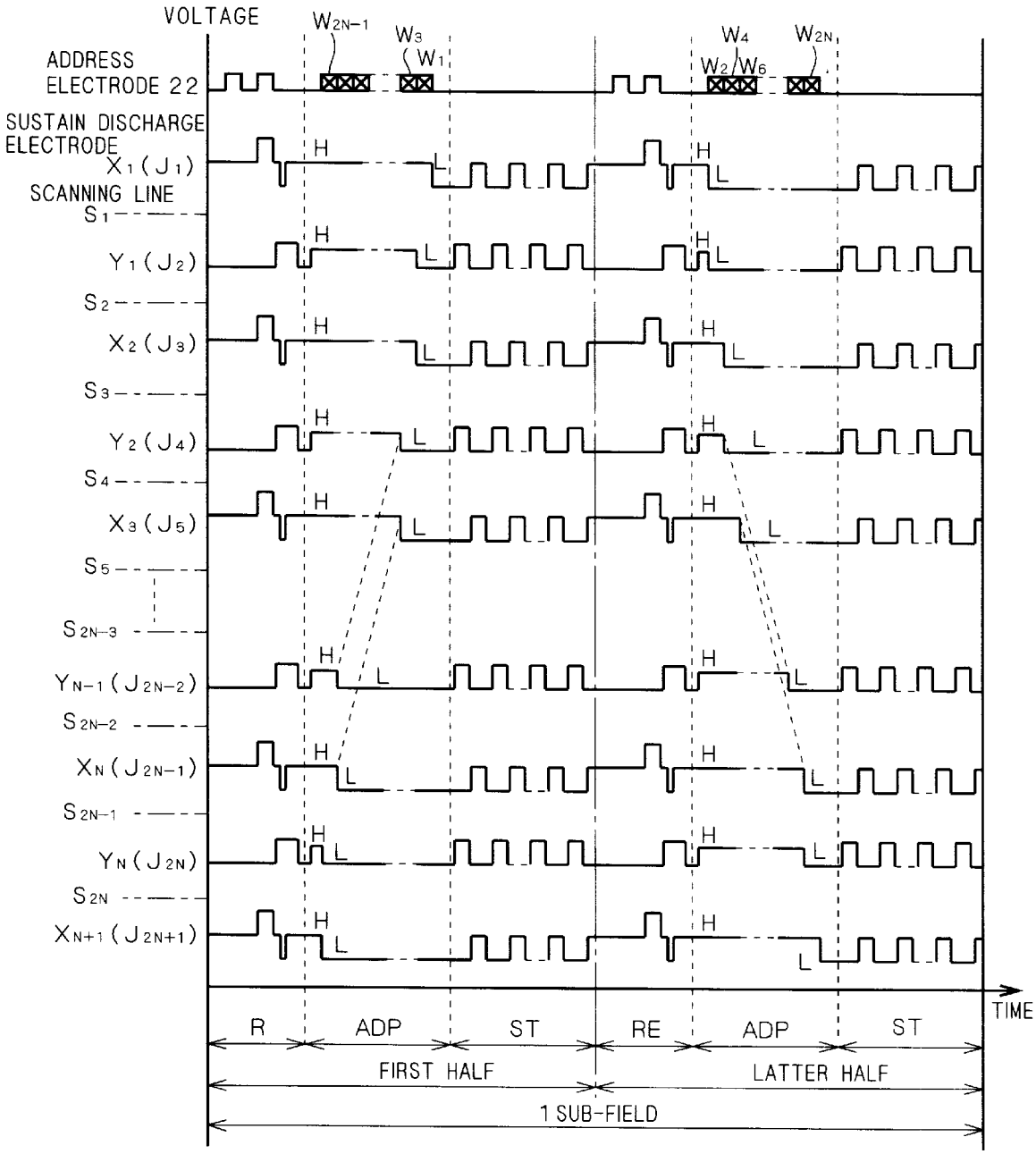
FIG. 21 is a timing chart used for an explanation of a method of driving an AC-type PDP in the background art.

An exemplary specific method of driving the AC-type PDP 200 by the driving device 201 will be discussed, referring to the timing chart of FIG. 21. FIG. 21 shows a sequence of the voltage applied to the sustain discharge electrodes X and Y and the address electrodes 22 in one sub-field. As shown in FIG. 21, one sub-field is broadly divided into the first half and the latter half and each half includes a reset period R, a writing period ADP and the sustain period ST. In FIG. 21, the waveform of the voltage applied to the address electrode 22 in the writing period ADP shows that the voltage Von or Voff is applied to each of a plurality of address electrodes 22 according to each image data $W_i$ of each discharge cell belonging to the selected scanning line $S_i$ ($1 \leqq i \leqq 2N$).

First, a driving method in the first half of the sub-field will be discussed. In reset period R, the wall charges stored as the image data of the immediately-preceding sub-field are erased.

In writing period ADP, after applying the voltage H to all the sustain discharge electrodes X and Y before the start of scanning, odd-numbered scanning lines S are selected in descending order, i.e., in the order of the scanning line $S_{2N-1}$, the scanning line $S_{2N-3}$, . . . , the scanning line $S_3$ and the scanning line $S_1$.

Discussing the sequence of the scanning, in synchronization with application of the voltage Von or Voff according to the image data $W_{2N-1}$ to the address electrode 22, the voltages at the sustain discharge electrodes $Y_N$ and $X_{N+1}$ are switched or changed from the voltage H to the voltage L. With this operation, the voltages at the sustain discharge electrodes $X_N$ and $Y_N$ defining the scanning line $S_{2N-1}$ become the voltage H and the voltage L, respectively, while both the voltages at the sustain discharge electrodes $Y_N$ and $X_{N+1}$ defining the scanning line $S_{2N}$ become the voltage L and both the voltages at the sustain discharge electrodes X and Y defining the scanning lines $S_1$ to $S_{2N-2}$ become the voltage H. As a result, the writing discharge can be selectively generated in the discharge cell belonging to the address electrode 22 to which the voltage Von is applied among the discharge cells belonging to the scanning line $S_{2N-1}$.

Subsequently, in synchronization with output of the image data $W_{2N-3}$ to the address electrode 22, the voltages at the sustain discharge electrodes $Y_{N-1}$ and $X_N$ are switched to the voltage L. With this operation, the voltages at the sustain discharge electrodes $X_{N-1}$ and $Y_{N-1}$ defining the scanning line $S_{2N-3}$ become the voltage H and the voltage L, respectively, while both the voltages at the sustain discharge electrodes X and Y defining the scanning lines $S_{2N-2}$ to $S_{2N}$ become the voltage L and both the voltages at the sustain discharge electrodes X and Y defining the scanning lines $S_1$ to $S_{1N-4}$ become the voltage H. As a result, the writing discharge can be selectively generated in the discharge cell belonging to the address electrode 22 to which the voltage Von is applied among the discharge cells belonging to the scanning line $S_{2N-3}$.

Thus, in the writing period ADP of the first half of the sub-field, by switching the voltages at the sustain discharge electrodes $Y_n$ and $X_{n+1}$ ($1 \leqq n \leqq N$) to the voltage L in descending order, the odd-numbered scanning lines $S_{2n-1}$ are selected in descending order. After performing the writing operation on up to the scanning line $S_1$, the voltage at the sustain discharge electrode $X_1$ is switched to the voltage L.

Then, after completing the writing period ADP of the first half of the sub-field, subsequently, the sustain period ST is executed only on the odd-numbered scanning lines $S_{2n-1}$, to generate the sustain discharge. Specifically, the sustain pulse (sustain voltage) is alternately applied between the sustain discharge electrodes X and Y or an AC pulse is applied to the sustain discharge electrodes X and Y.

After the end of the driving sequence in the first half of the sub-field, the driving sequence in the latter half of the sub-field is performed.

First in the reset period R, the image data of the first half of the sub-field is erased. Then, in the writing period ADP, after the voltage H is applied to all the sustain discharge electrodes X and Y before the start of scanning, the even-numbered scanning lines S are selected in ascending order, i.e., in the order of the scanning line $S_2$, the scanning line $S_4$, . . . , the scanning line $S_{2N-2}$ and the scanning line $S_{2N}$.

Discussing sequentially, in synchronization with application of the voltage Von or Voff according to the image data $W_2$ to the address electrode 22, the voltages at the sustain discharge electrodes $Y_1$ and $X_1$ are switched from the voltage H to the voltage L. With this operation, the voltages at the sustain discharge electrodes $Y_1$ and $X_2$ defining the scanning line $S_2$ become the voltage L and the voltage H, respectively, while both the voltages at the sustain discharge electrodes $Y_1$ and $X_1$ defining the scanning line $S_1$ become the voltage L and both the voltages at the sustain discharge electrodes X and Y defining the scanning lines $S_3$ to $S_{2N}$ become the voltage H. As a result, the writing discharge can be selectively generated in the discharge cell belonging to the address electrode 22 to which the voltage Von is applied among the discharge cells belonging to the scanning line $S_2$.

Subsequently, in synchronization with output of the image data $W_4$ to the address electrode 22, the voltages at the sustain discharge electrodes $Y_2$ and $X_2$ are switched to the voltage L. With this operation, the voltages at the sustain discharge electrodes $Y_2$ and $X_3$ defining the scanning line $S_4$ become the voltage L and the voltage H, respectively, while both the voltages at the sustain discharge electrodes X and Y defining the scanning lines $S_1$ to $S_3$ become the voltage L and both the voltages at the sustain discharge electrodes X and Y defining the scanning lines $S_5$ to $S_{2N}$ become the voltage H. As a result, the writing discharge can be selectively generated in the discharge cell belonging to the address electrode 22 to which the voltage Von is applied among the discharge cells belonging to the scanning line $S_4$.

Thus, in the writing period ADP of the latter half of the sub-field, by switching the voltages at the sustain discharge electrodes $Y_n$ and $X_n$ ($1 \leqq n \leqq N$) to the voltage L in ascending order, the even-numbered scanning lines $S_{2n}$ are selected in ascending order. After performing the writing operation on up to the scanning line $S_{2N}$, the voltage at the sustain discharge electrode $X_{N-1}$ is switched to the voltage L.

Then, after completing the writing period ADP of the latter half of the sub-field, subsequently, the sustain period ST is executed only on the even-numbered scanning lines $S_{2n}$, to generate the sustain discharge.

In the driving sequence of FIG. 21, one sub-field has two reset periods R. In the reset period R, a priming discharge and the erase discharge are generated in all the discharge cells. Since these discharges illuminate the discharge cells, if the reset periods R or erase operations are performed in many times, dark luminance (background luminance) of the sub-field sometimes accordingly rises, to degrade the display contrast.

Further, according to the driving sequence of FIG. 21, in the sustain periods ST of the first half and the latter half of the sub-field, the sustain discharge is generated only in the odd-numbered scanning lines S and the even-numbered scanning lines S, respectively. At this time, in the sustain period ST of the first half of the sub-field, the AC pulse is also applied between the sustain discharge electrodes X and Y defining the even-numbered scanning lines S in which no sustain discharge is generated, and conversely, in the sustain period ST of the latter half of the sub-field, the AC pulse is also applied between the sustain discharge electrodes X and Y defining the odd-numbered scanning lines S in which no sustain discharge is generated. In this case, reactive power is consumed also in the discharge cells in which no sustain discharge is generated in the sustain periods ST and the power consumption of the whole AC-type PDP 200 may sometimes become larger.

Furthermore, in the driving sequence of FIG. 21, one sub-field has two reset periods R and two sustain periods ST. Therefore, if the time required for the two reset periods R and the two sustain periods ST is long, the time assigned for the writing period ADP is reduced. At this time, performing the writing operation in the writing period ADP at high speed causes no problem but in such a case, sometimes the writing discharge is likely to be unstabilized and the writing operation can not be achieved with reliability.

<The First Preferred Embodiment>

Considering the above, the first preferred embodiment provides a method of driving the AC-type PDP 200, which produces effects of enhancing the display contrast, reducing the reactive power and stabilizing the writing discharge, at the same time.

In the discussion on the background art, the electrode to which the voltage H is applied at selection of the scanning lines S in the writing period ADP is referred to as the sustain discharge electrode X and the electrode to which the voltage L is applied is referred to as the sustain discharge electrode Y, while in the following discussion, the sustain discharge electrodes X and Y are not distinguished and each of the (2N+1) sustain discharge electrodes is referred to as "sustain discharge electrode J". To distinguish the (2N+1) sustain discharge electrodes J, giving subscript i ($1 \leqq i \leqq 2N+1$), for example, each of the sustain discharge electrodes J is referred to as "sustain discharge electrode $J_i$". Specifically, the sustain discharge electrodes $X_1$, $Y_1$, $X_2$, $Y_2$, . . . , $X_{N-1}$, $Y_{N-1}$, $X_N$, and $X_{N+1}$ correspond to the sustain discharge electrodes $J_1$, $J_2$, $J_3$, $J_4$, . . . , $J_{2N-3}$, $J_{2N-2}$, $J_{2N-1}$, $J_{2N}$ and $J_{2N+1}$. In this case, the sustain discharge electrodes $J_i$ and $J_{i+1}$, define the i-th scanning line Si.

Figure 1:
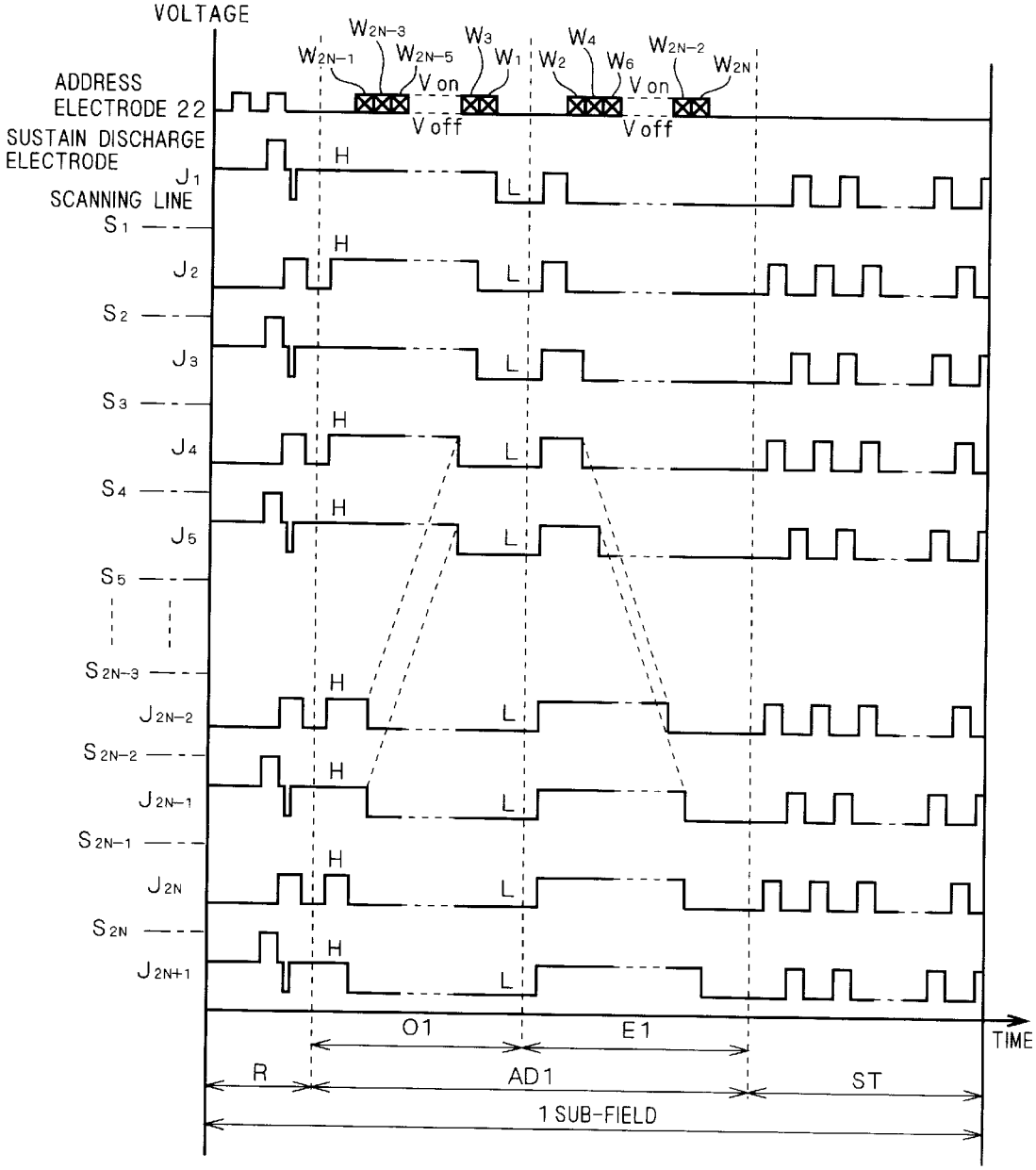
FIG. 1 is a timing chart used for an explanation of a method of driving an AC-type PDP in accordance with a first preferred embodiment of the present invention.

FIG. 1 is a timing chart showing a method of driving the AC-type PDP 200 in accordance with the first preferred embodiment. FIG. 1 shows a voltage sequence of voltages applied to the address electrodes 22 and each sustain discharge electrode J for one sub-field. As shown in FIG. 1, the driving method of the first preferred embodiment includes only one reset period R at the initial time of one sub-field and only-one sustain period ST at the end thereof. In the reset period R and the sustain period ST, the erase operation and the discharge sustain operation are performed on all the discharge cells.

Further, one sub-field includes only one writing period AD1 between the reset period R and the sustain period ST. The writing period AD1 consists of a (odd-numbered scanning-line) writing period O1 for scanning the odd-numbered scanning lines S and a (even-numbered scanning-line) writing period E1 for scanning the even-numbered scanning lines S.

In the odd-numbered scanning-line writing period O1, a driving sequence which is the same as that in the writing period ADP in the first half of the sub-field shown in FIG. 21 is performed. Specifically, the voltage H is applied to all the sustain discharge electrodes J before the start of the scanning. Subsequently, the odd-numbered scanning lines S are selected in descending order, i.e., in the order of the scanning line $S_{2N-1}$, the scanning line $S_{2N-3}$, . . . , the scanning line $S_3$ and the scanning line $S_1$. In this case, a combination of the voltage H and the voltage L are applied to two sustain discharge electrodes J defining the selected scanning line S. For example, the selection of the scanning line $S_{2n-1}$ ($1 \leqq n \leqq N$) is performed by switching the voltages at the sustain discharge electrodes $J_{2n}$ and the $J_{2n+1}$ from the voltage H to the voltage L. At this time, according to the timing of selection of each scanning line S, the image data W of the selected scanning line S is applied to the address electrodes 22. After the end of selection of the scanning line $S_1$, the voltage at the sustain discharge electrode $J_1$ is switched to the voltage L.

Subsequent to the writing period O1, the even-numbered scanning-line writing period E1 is executed. In the writing period E1, the voltages at all the sustain discharge electrodes J are switched to the voltage H before the start of the scanning. After that, a driving sequence which is the same as that in the writing period ADP in the latter half of the sub-field shown in FIG. 21 is performed. Specifically, the even-numbered scanning lines S are selected in ascending order, i.e., in the order of the scanning line $S_2$, the scanning line $S_4$, . . . , the scanning line $S_{2N-2}$ and the scanning line $S_{2N}$, and in synchronization with the selection of the scanning lines S, the image data W are outputted to the address electrodes 22. For example, the selection of the scanning line $S_{2n}$ is performed by switching the voltages at the sustain discharge electrodes $J_{2n}$ and the $J_{2n-1}$ from the voltage H to the voltage L. After the end of selection of the scanning line $S_{2N}$, the voltage at the sustain discharge electrode $J_{2N+1}$, is switched to the voltage L.

Thus, in the driving method of the first preferred embodiment, all the scanning lines S are divided into the odd-numbered group and the even-numbered group, and the writing operation is performed on a group-by-group basis in the writing period. Further, according to this grouping, the scanning lines in the same group are not adjacent to one another.

In the driving method of the first preferred embodiment, the writing operation according to the image data for one-subfield is performed on all the scanning lines S or all the discharge cells in writing period AD1 before the sustain period ST. Therefore, in the subsequent sustain period ST, the sustain discharge is generated simultaneously in all the discharge cells for one sub-field. In other words, in the driving method of the first preferred embodiment, since the odd-numbered scanning-line writing period O1 and the even-numbered scanning line writing period E1 are successively performed in the writing period AD1, only one sustain period ST is needed for one sub-field. Accordingly, the reactive power consumed in the discharge cells in which no sustain discharge is generated in the sustain period ST can be remarkably reduced as compared with the driving method shown in FIG. 21.

Further, in the driving method of the first preferred embodiment, only one reset period R is performed before the writing period AD1. That reduces the dark luminance and enhances the display contrast as compared with the driving method shown in FIG. 21.

Furthermore, since the time required for the reset period R and the sustain period ST for one sub-field is remarkably reduced as compared with the driving method shown in FIG. 21, the time assigned for the writing period ADI can be increased. As a result, the writing discharge can be generated with more stability or more reliability.

<The Second Preferred Embodiment>

The writing discharge in the discharge cell of the AC-type PDP 200 is generated as follows. Between the sustain discharge electrode J to which the voltage L is applied among two sustain discharge electrodes defining the selected scanning line S and the address electrode 22 to which the voltage Von is applied, a strong electric field is produced, to generate an opposite discharge between the sustain discharge electrode J and the address electrodes 22. Then, with space charges generated in the discharge cell by the opposite discharge as a trigger, the surface discharge is generated between the sustain discharge electrode J to which the voltage L is applied and the sustain discharge electrode J which defines the selected scanning line S and to which the voltage H is applied. The writing discharge consists of a series of the opposite discharge and the surface discharge. In consideration of this, the voltage L has a value that can generate the opposite discharge (accordingly, writing discharge) between the address electrode 22 and the sustain discharge electrode J to which the voltage L is applied when the voltage Von is applied to the address electrodes 22.

In the AC-type PDP 200, however, when the opposite discharge is generated, an unnecessary opposite discharge is sometimes generated in the scanning line S adjacent to the selected scanning line S. In detail, since the opposite discharge is generated between the address electrode 22 and the sustain discharge electrode J to which the voltage L is applied, the opposite discharge is also generated in the scanning line S adjacent to the selected scanning line S sharing the sustain discharge electrode J to which the voltage L is applied, which is the unnecessary opposite discharge.

When such an unnecessary discharge is generated, positive charges are sometimes accumulated or stored on the exposed portion of the cathode film 11 in the discharge cells belonging to the adjacent scanning line S, i.e., above the sustain discharge electrode J to which the voltage L is applied. Further, unnecessary negative charges, corresponding to the unnecessary positive charges, are sometimes accumulated on the phosphor layer 24 opposite to the cathode film 11 with the discharge space interposed therebetween.

Such an unnecessary opposite discharge can be generated and such unnecessary electric charges can be accumulated in both the driving method shown in FIG. 21 and that shown in FIG. 1 discussed earlier. For example, in the driving method shown in FIG. 1, in the preceding writing period O1, the unnecessary opposite discharge is generated and the unnecessary electric charges are accumulated in the discharge cells belonging to the even-numbered scanning lines $S_{2n}$ which are not selected in the writing period O1.

In this case, the electric field in which the unnecessary positive and negative charges are generated may impede the (normal) writing discharge in the following writing period E1. For example, In the writing period O1, when the scanning line $S_1$ is selected, the unnecessary positive charges are accumulated above the scanning line $S_2$ adjacent to the sustain discharge electrode $J_2$ to which the voltage L is applied and the unnecessary negative charges are accumulated on the phosphor layer 24 opposed thereto, i.e., above the address electrode 22. In such a case, in the following writing period E1, when the scanning line $S_2$ is selected, even though the voltage L is applied to the sustain discharge electrode $J_2$ and the voltage Von is applied to the address electrode 22, the electric field between the sustain discharge electrode $J_2$ and the address electrode 22 is weakened by the electric field produced by the unnecessary positive charges and negative charges. Therefore, there may be a case where the normal opposite discharge to generate the writing discharge is not generated and the writing operation can not be performed at the selection of the scanning line $S_2$. That causes some disadvantages in image display such as not-lighting.

Then, in the second preferred embodiment, a driving method by which the writing operation can be reliably performed even if the unnecessary electric charges are accumulated by the unnecessary opposite discharge.

Figure 2:
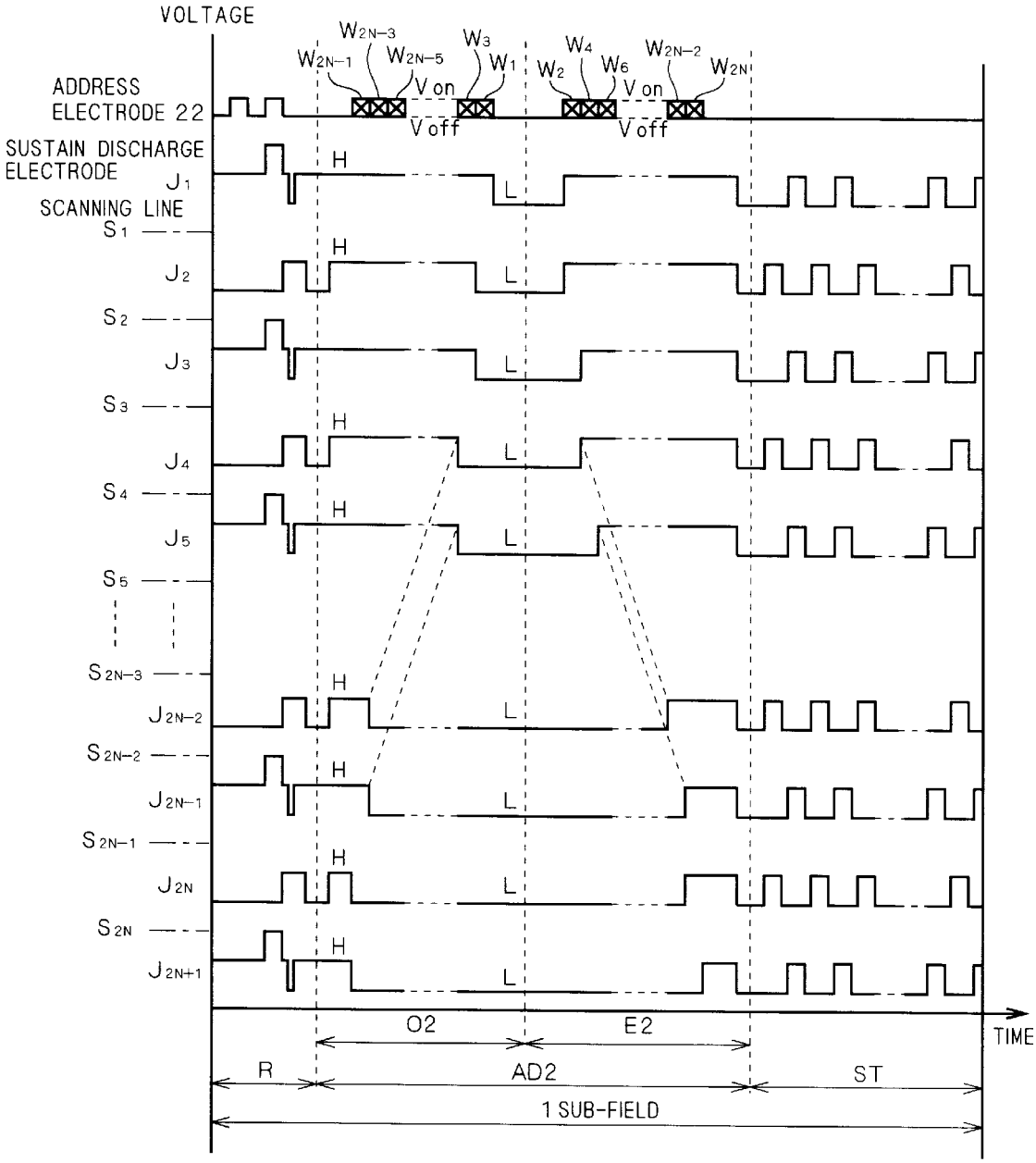
FIG. 2 is a timing chart used for an explanation of a method of driving an AC-type PDP in accordance with a second preferred embodiment of the present invention.

FIG. 2 is a timing chart showing a driving method in accordance with the second preferred embodiment. FIG. 2 shows a voltage sequence of voltages applied to the address electrode 22 and the sustain discharge electrodes J for one sub-field. Like in the driving method shown in FIG. 1 discussed earlier, the driving method of the second preferred embodiment includes only one reset period R at the initial time of one sub-field and only one sustain period ST at the end thereof. Further, only one writing period AD2 is provided between the reset period R and the sustain period ST.

The writing period AD2 consists of a (odd-numbered scanning-line) writing period O2 for scanning the odd-numbered scanning lines S and a (even-numbered scanning-line) writing period E2 for scanning the even-numbered scanning lines S.

In the odd-numbered scanning-line writing period O2, a driving sequence which is the same as that in the writing period O1 shown in FIG. 1 is performed, and specifically, the odd-numbered scanning lines S are selected in descending order, i.e., in the order of the scanning line $S_{2N-1}$, the scanning line $S_{2N-3}$, . . . , the scanning line $S_3$ and the scanning line $S_1$.

In the driving method of the second preferred embodiment, particularly, after the voltage at the sustain discharge electrode $J_1$ is switched to the voltage L at the end of the writing period O2, the scanning of the even-numbered scanning lines is performed without changing the voltages applied to the sustain discharge electrodes J before the start of the scanning in the writing period E2. Specifically, unlike the above-discussed driving method shown in FIG. 1, the scanning of the even-numbered scanning lines S starts without switching the voltages at all the sustain discharge electrodes J to the voltage H, remaining at the voltage L.

In detail, immediately before the start of the writing period E2, i.e., at the end of the writing period O2, the voltage L is applied to all the sustain discharge electrodes J. In the writing period E2, starting with the voltage L applied, the voltages applied to the sustain discharge electrodes $J_1$ and $J_2$ are switched from the voltage L to the voltage H in synchronization with the timing of outputting the image data $W_2$ to the address electrode 22. With this operation, the voltages at the sustain discharge electrodes $J_2$ and $J_3$ defining the scanning line $S_2$ become the voltage H and the voltage L, respectively, while both the voltages at the sustain discharge electrodes $J_1$ and $J_2$ defining the scanning line $S_1$ become the voltage H and both the voltages at the sustain discharge electrodes J defining the scanning lines $S_3$ to $S_{2N}$ become the voltage L. As a result, the writing discharge can be selectively generated in the discharge cell belonging to the address electrode 22 to which the voltage Von is applied among the discharge cells belonging to the scanning line $S_2$.

Subsequently, the voltages applied to the sustain discharge electrodes $J_3$ and $J_4$ are switched to the voltage H in synchronization with the timing of outputting the image data $W_4$ to the address electrode 22. With this operation, the voltages at the sustain discharge electrodes $J_4$ and $J_5$ defining the scanning line $S_4$ become the voltage H and the voltage L, respectively, while both the voltages at the sustain discharge electrodes defining the scanning lines $S_1$ to $S_3$ become the voltage H and both the voltages at the sustain discharge electrodes J defining the scanning lines $S_5$ to $S_{2N}$ become the voltage L. As a result, the writing discharge can be selectively generated in the discharge cell belonging to the address electrode 22 to which the voltage Von is applied among the discharge cells belonging to the scanning line $S_4$.

Similarly, in synchronization with the timing of outputting the image data $W_6$, $W_8$, . . . , $W_{2N-2}$ and $W_{2N}$ to the address electrodes 22, the voltages applied to the sustain discharge electrodes $J_5$ and $J_6$, the sustain discharge electrodes $J_7$ and $J_8$, . . . , the sustain discharge electrodes $J_{2N-3}$ and $J_{2N-2}$ and the sustain discharge electrodes $J_{2N-1}$ and $J_{2N}$ are sequentially switched to the voltage H. Thus, in the writing period, E2, the selection of the even-numbered scanning lines S is performed in ascending order. After the end of the selection of the scanning line $S_{2N}$, the voltage at the sustain discharge electrode $J_{2N+1}$ is switched to the voltage H, and after that, the voltages at all the sustain discharge electrodes J are switched to the voltage L simultaneously. With this switching to the voltage L, the above-discussed sustain period ST shown in FIG. 1 can be used as the sustain period ST in the driving method of the second preferred embodiment.

In the driving method of the second preferred embodiment, particularly, when the odd-numbered scanning lines $S_{2n-1}$, are selected in the writing period O2, the voltage H is applied to the sustain discharge electrode $J_{2n-1}$ corresponding to the sustain discharge electrode X ($X_n$) in the discussion of the background art and the voltage L is applied to the sustain discharge electrode $J_{2n}$ corresponding to the sustain discharge electrode Y ($Y_n$). On the other hand, when the even-numbered scanning lines $S_{2n}$ are selected in the writing period E2, conversely to the writing period O2, the voltage L is applied to the sustain discharge electrode $J_{2n+1}$ corresponding to the sustain discharge electrode X ($X_{n+1}$) and the voltage H is applied to the sustain discharge electrode $J_{2n}$ corresponding to the sustain discharge electrode Y ($Y_n$).

Thus, in the driving method of the second preferred embodiment, the voltages applied to said sustain discharge electrodes J in the writing periods O2 and E2 are reverse in polarity to each other when the writing discharge is generated. In other words, a potential difference (the voltage H–the voltage L) of the sustain discharge electrode (a second or third sustain discharge electrode) $J_{2n-1}$ to the sustain discharge electrode (a first sustain discharge electrode) $J_{2n}$ at the selection of the scanning line $S_{2n-1}$ in the writing period O2 which is one of the two scanning lines sharing the sustain discharge electrode $J_{2n}$ is reverse in polarity to a potential difference (the voltage L–the voltage H) of the sustain discharge electrode (a third or second sustain discharge electrode) $J_{2n+1}$ to the sustain discharge electrode $J_{2n}$ at the selection of the scanning line $S_{2n}$ in the writing period E2 which is the other of the two scanning lines sharing the sustain discharge electrode $J_{2n}$. Such an application of the voltages is represented as "the voltages applied to the sustain discharge electrodes defining the scanning line are bidirectional in polarity."

On the other hand, in the driving method shown in FIG. 21 discussed earlier, the voltages applied to the sustain discharge electrodes X and Y are equal, not being changed, in the first half and the latter half of one sub-field when the writing discharges are generated. For example, in FIG. 21, the voltage L is applied to the sustain discharge electrode $Y_1$ when the writing discharge is generated both at the selection of the scanning line $S_1$ with a pair of the sustain discharge electrode $Y_1$ and the sustain discharge electrode $X_1$ and the selection of the scanning line $S_2$ with a pair of the sustain discharge electrode $Y_1$ and the sustain discharge electrode $X_2$. Such an application of the voltages is represented as "the voltages applied to the sustain discharge electrodes defining the scanning line are unidirectional in polarity." Further, in the driving method shown in FIG. 1, the voltages applied to the sustain discharge electrodes defining the selected scanning line S are unidirectional in polarity.

The driving method of the second preferred embodiment can produce the following effects as well as the effects of the driving method shown in FIG. 1 discussed earlier. In the driving method of the second preferred embodiment, without changing the voltage applied to the sustain discharge electrode J from the end of the scanning in the preceding writing period O2, the scanning in the following writing period E2 starts. Therefore, switching of the voltage applied to the sustain discharge electrode J is required only at the selection of the scanning line. In contrast to this, in the driving method shown in FIG. 1, the applied voltage is switched both at the selection of the scanning line and before the start of the scanning in the writing period E2 (not related to the selection of the scanning line). Accordingly, the driving method of the second preferred embodiment can reduce the number of switching operations for the applied voltage as compared with that in the driving method shown in FIG. 1. This simplifies the driving sequence of the circuit for supplying the sustain discharge electrode J with the voltage (driving device), thereby reducing the load on the circuit.

In particular, the following effect can be produced by the bidirectional polarity of the voltages applied to the sustain discharge electrodes defining the selected scanning line S.

First, even when the earlier-discussed unnecessary positive and negative charges are accumulated, the writing operation can be performed with reliability. In detail, in the writing period E2 of the driving method of the second preferred embodiment, the voltage L is applied not to the sustain discharge electrode $J_{2n}$ but to the sustain discharge electrode $J_{2n+1}$ at the selection of the scanning line $S_{2n}$. Therefore, in the preceding writing period O2, even when the unnecessary positive charges are accumulated above the sustain discharge electrode $J_{2n}$ and the unnecessary negative charges are accumulated above the address electrode 22, the opposite discharge between the sustain discharge electrode $J_{2n+1}$ and the address electrode 22 is not directly impeded. Accordingly, the writing discharge can be generated with more reliability or more stability in the writing period E2 as compared with the driving method shown in FIG. 1.

<The First Variation of The Second Preferred Embodiment>

Figure 3:
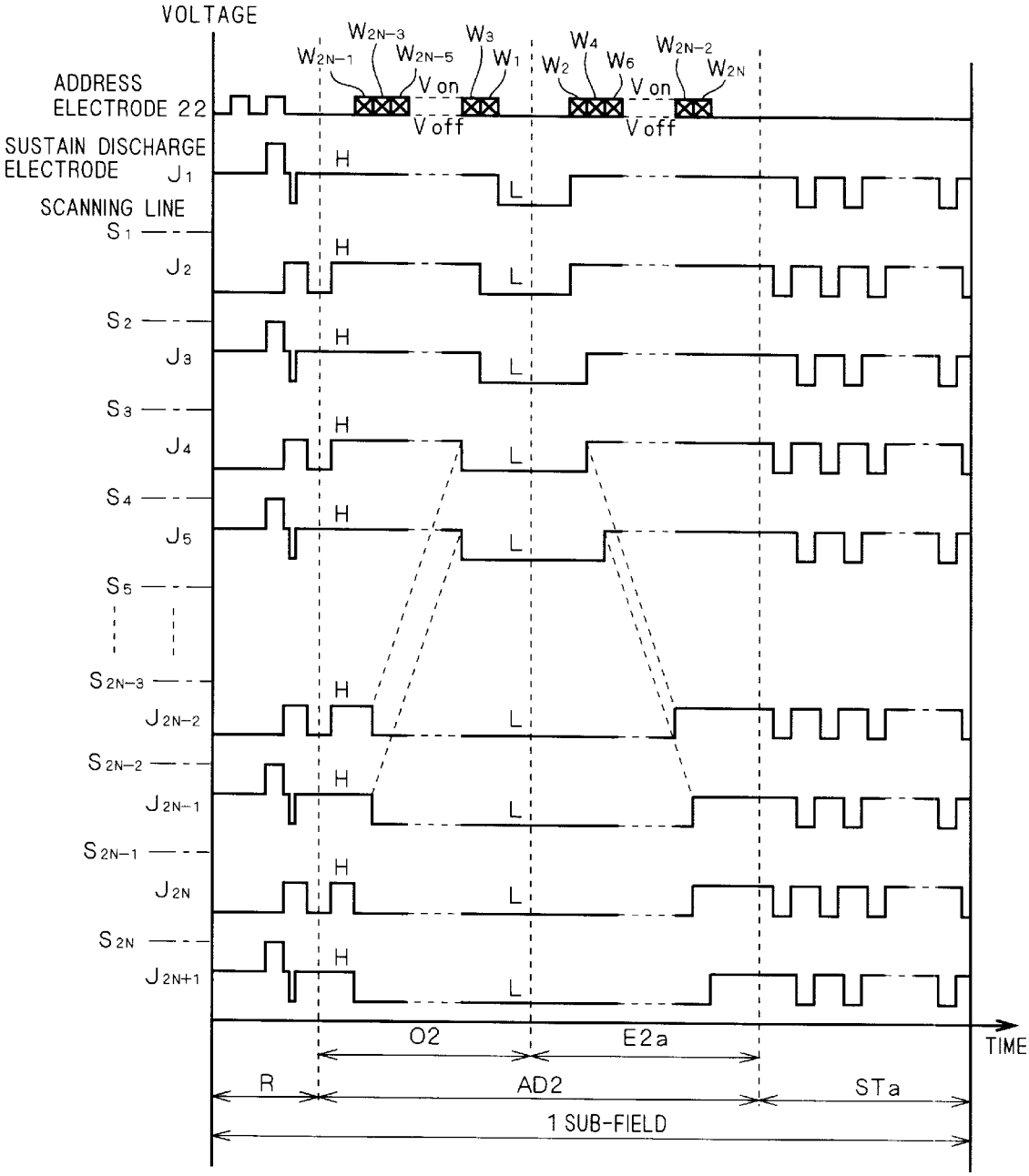
FIG. 3 is a timing chart used for an explanation of a method of driving an AC-type PDP in accordance with a first variation of the second preferred embodiment of the present invention.

Considering that all the sustain discharge electrodes J have only to be set to the low-voltage side or the high-voltage side of the sustain pulse at the start of the sustain period ST, the timing chart of FIG. 3 can be applied to a method of driving the AC-type PDP 200. The driving method shown in the timing chart of FIG. 3 is the same as that shown in the timing chart of FIG. 2 except for the driving method in the writing period E2*a* corresponding to the above-discussed writing period E2 and the sustain period STa corresponding to the above-discussed sustain period ST.

In the driving method of the first variation of the second preferred embodiment, the even-numbered scanning lines S are selected in ascending order and after the selection of the scanning line $S_{2N}$, the voltage at the sustain discharge electrode $J_{2N+1}$ is switched to the voltage H in the writing period E2*a*, like in the writing period E2 (see FIG. 2). After that, unlike in the timing chart of FIG. 2, the writing period E2*a* is ended with the voltage H applied to all the sustain discharge electrodes J.

Then, the sustain period STa is executed with reversed ones of the sustain pulses in the timing chart of FIG. 2. At this time, in consideration of continuity in voltage to the reset period R of the next sub-field, at the end of the sustain period STa, the number of sustain pulses is set so that the voltages at the odd-numbered sustain discharge electrodes $J_{2n-1}$ may become the voltage H and the voltages at the even-numbered sustain discharge electrodes $J_{2n}$ may become the voltage L.

The driving method of the first variation of the second preferred embodiment can also produce the effects of that of the second preferred embodiment. Further, in the driving method of the first variation of the second preferred embodiment, the discharge sustain operation starts in the sustain period STa without changing the voltage applied to the sustain discharge electrodes J from the end of the writing period AD2. In contrast to this, in the driving methods shown in FIGS. 1 and 2, the applied voltage is switched to the voltage L (a predetermined initial value) before the start of the sustain period ST. Therefore, the driving method of the first variation of the second preferred embodiment can reduce the number of switching operations for the applied voltage as compared with the driving method shown in FIG. 1 or the like. This simplifies the driving sequence of the circuit for supplying the sustain discharge electrode J with the voltage, thereby reducing the load on the circuit. Furthermore, the driving method in which the voltage applied to the sustain discharge electrode J not changed, being continuous, between the end of the writing period and the start of the sustain period can be applied to the driving methods discussed later.

<The Second Variation of The Second Preferred Embodiment>

Figure 4:
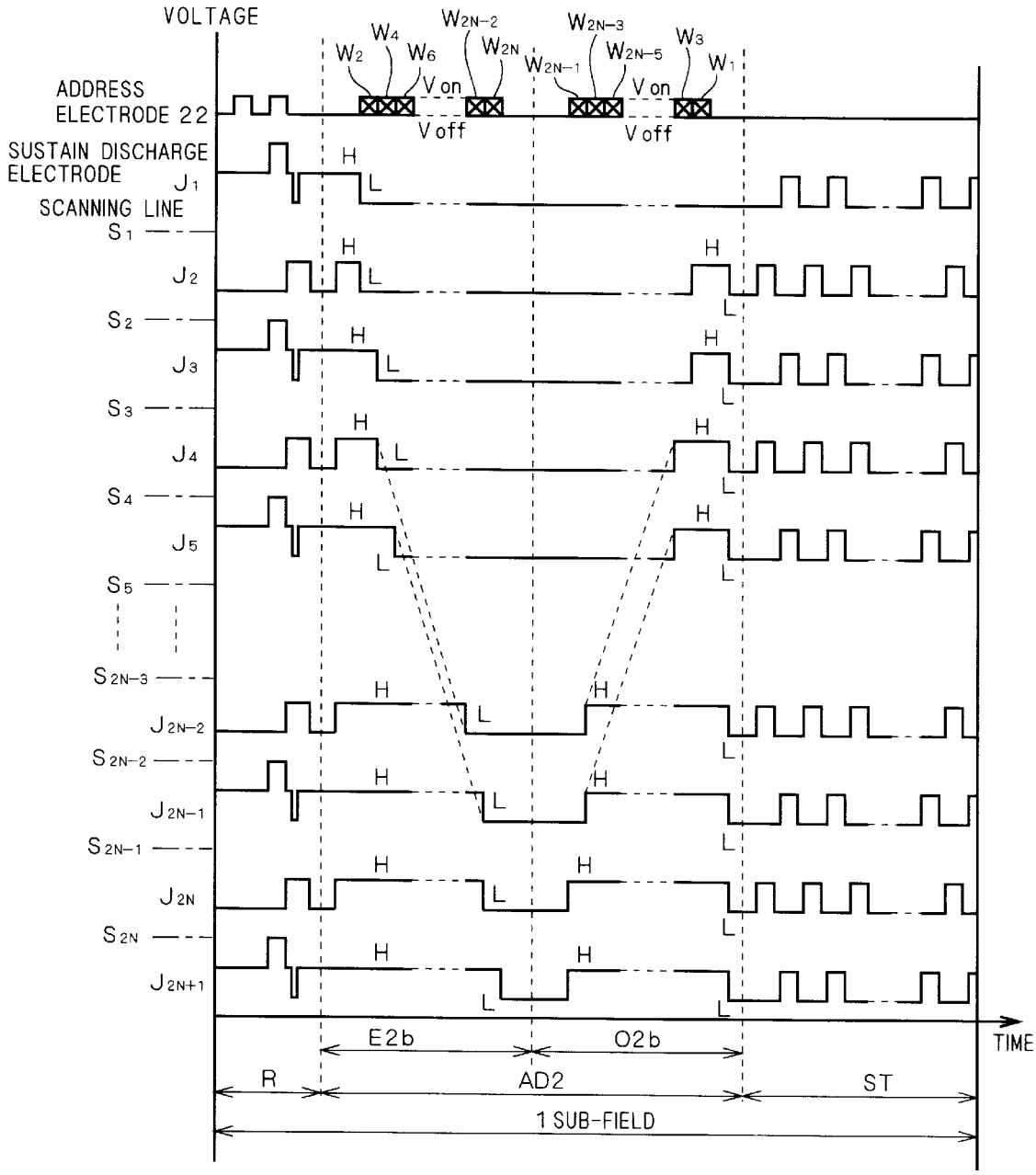
FIG. 4 is a timing chart used for an explanation of a method of driving an AC-type PDP in accordance with a second variation of the second preferred embodiment of the present invention.

FIG. 4 is a timing chart used for an explanation of a driving method in accordance with the second variation of the second preferred embodiment. In the driving method shown in FIG. 4, the order of the two writing periods O2 and E2 in the driving method shown in FIG. 2 is changed over. Specifically, in the writing period AD2, the even-numbered scanning-line writing period E2*b* is first executed and next the odd-numbered scanning-line writing period O2*b* is executed. The reset period R and the sustain period ST are the same as those of FIG. 2.

In detail, in the preceding writing period E2*b* executed is a driving sequence which is the same as that of the writing period ADP in the latter half of the one sub-field shown in FIG. 21. With this execution, the even-numbered scanning lines are selected in ascending order.

The following writing period O2*b* starts with the voltage L applied to all the sustain discharge electrodes. In the writing period O2*b*, the image data $W_{2N-1}$, $W_{2N-3}$, $W_{2N-5}$, . . . , $W_3$ and $W_1$ are outputted to the address electrodes 22 in descending order and in synchronization with this output of the image data, the voltages at the sustain discharge electrodes $J_{2N+1}$ and $J_{2N}$, the sustain discharge electrodes $J_{2N-1}$ and $J_{2N-2}$, the sustain discharge electrodes $J_{2N-3}$ and $J_{2N-4}$, . . . , the sustain discharge electrodes $J_5$ and $J_4$ and the sustain discharge electrodes $J_3$ and $J_2$ are sequentially switched to the voltage H. Then, after the voltages applied to all the sustain discharge electrodes J are switched to the voltage L, the sustain period ST is executed. The driving method of the second variation of the second preferred embodiment can also produce the effects of that of the second preferred embodiment.

Further, there may be another case where the voltages at the sustain discharge electrodes J are switched to the voltage H at respective predetermined timings and after the switching operation for the voltage at the sustain discharge electrode $J_2$ is completed, the voltage at the sustain discharge electrode $J_1$ is switched to the voltage H and the sustain period STa of FIG. 3 is executed with the voltage H applied to all the sustain discharge electrodes J.

<The Third Variation of The Second Preferred Embodiment>

Figure 5:
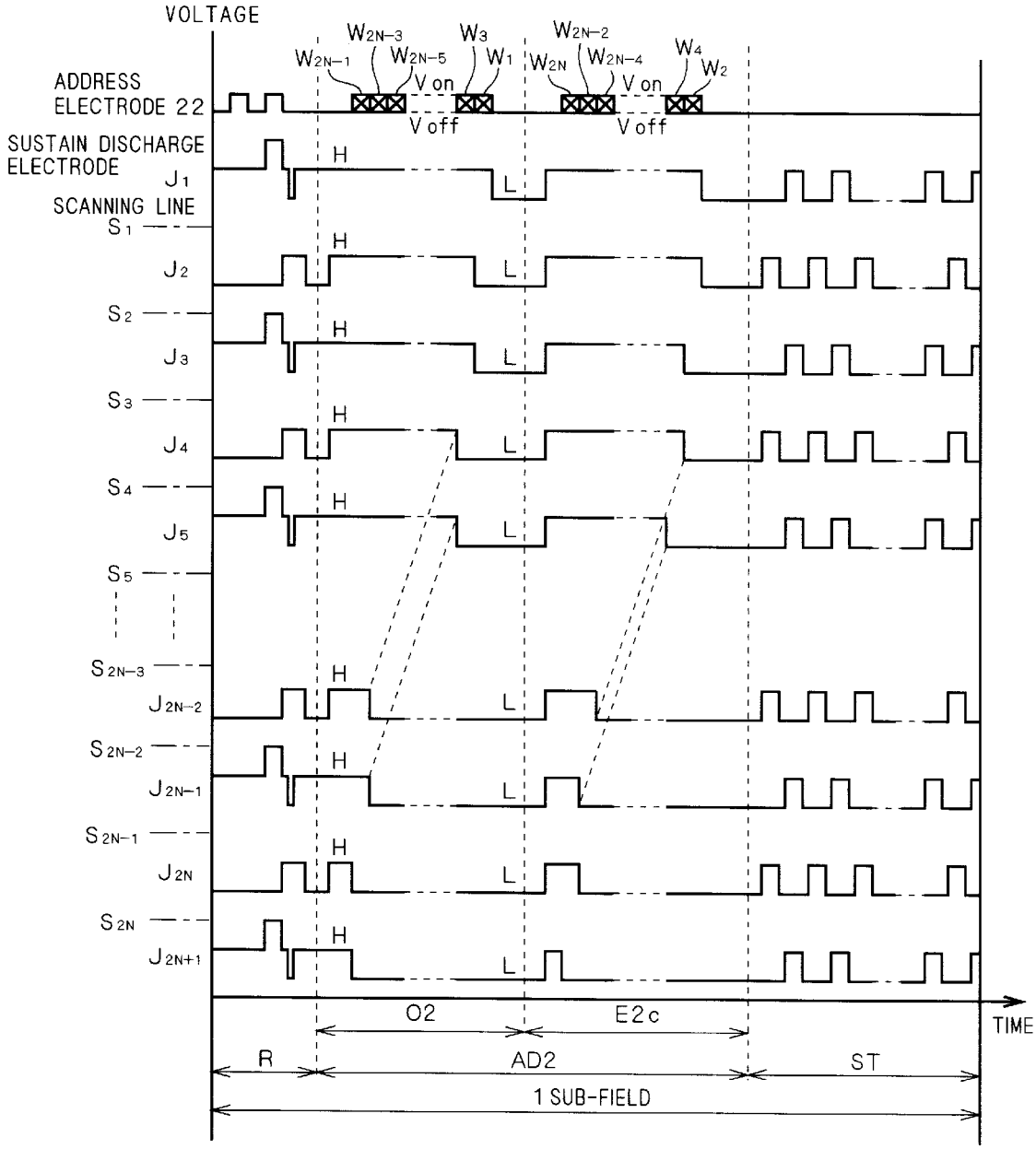
FIG. 5 is a timing chart used for an explanation of a method of driving an AC-type PDP in accordance with a third variation of the second preferred embodiment of the present invention.

FIG. 5 is a timing chart used for an explanation of a driving method in accordance with the third variation of the second preferred embodiment. In the driving method of the third variation of the second preferred embodiment, the driving sequence in the even-numbered scanning-line writing period E2*c* is different from that in the writing period E2 shown in FIG. 2. The reset period R, the writing period O2 and the sustain period ST are the same as those shown in FIG. 2.

In the writing period E2*c* of the driving method of the third variation of the second preferred embodiment, the voltage H is applied to all the sustain discharge electrodes J after the end of the preceding writing period O2 or before the start of the scanning in the writing period E2*c*. After that, the image data $W_{2N}$, $W_{2N-2}$, $W_{2N-4}$, . . . , $W_4$ and $W_2$ are outputted to the address electrodes 22 in descending order and in synchronization with this output of the image data, the voltages at the sustain discharge electrode $J_{2N+1}$, the sustain discharge electrodes $J_{2N}$ and $J_{2N-1}$, the sustain discharge electrodes $J_{2N-2}$ and $J_{2N-3}$, . . . , the sustain discharge electrodes $J_6$ and $J_5$ and the sustain discharge electrodes $J_4$ and $J_3$ are sequentially switched to the voltage L. With this operation, the scanning lines S are selected in descending order, i.e., in the order of the scanning line $S_{2N}$, the scanning line $S_{2N-2}$, scanning line $S_{2N-4}$, . . . , the scanning line $S_4$ and the scanning line $S_2$.

Also in the driving method of the third variation of the second preferred embodiment, since the voltages applied to the sustain discharge electrodes defining the scanning line S are bidirectional in polarity, the effects of the second preferred embodiment caused by the bidirectional polarity can be produced.

Thus, as variations of the driving method of the second preferred embodiment on whether the odd-numbered scanning-line writing period or the even-numbered scanning-line writing period is executed first, whether the voltage at the sustain discharge electrode J at the start of the scanning in each writing period is set to the voltage H or the voltage L, whether the scanning lines are selected in ascending order or descending order in the writing period, or the like, various driving sequences are possible and can be used.

<The Third Preferred Embodiment>

In the above-discussed driving method of the second preferred embodiment, the voltages at the odd-numbered sustain discharge electrodes $J_{2n+1}$ are switched from the voltage H to the voltage L in the writing period O2 and thereafter remain at the voltage L till the point of time when the voltages are returned to the voltage H in the following writing period E2. At this time, the voltage L is continuously applied to the sustain discharge electrodes $J_{2n+1}$ while the scannings at the writing periods O2 and E2 proceed in the order of the scanning line $S_{2n-1}$, scanning line $S_{2n-3}$, . . . , scanning line $S_3$, scanning line $S_1$, scanning line $S_2$, scanning line $S_4$, . . . , scanning line $S_{2n-2}$. Therefore, in the middle of the scanning, when the voltage Von is applied to the address electrode 22 according to the image data W of the scanning line S which is not associated with the sustain discharge electrode $J_{2n-1}$, unnecessary opposite discharge is sometimes generated between the sustain discharge electrode $J_{2n+1}$ to which the voltage L is applied and the address electrode 22 to which the voltage Von is applied in the discharge cell belonging to the scanning line $S_2$n not to be selected. As a result, sometimes, the writing discharge is not generated in the discharge cells belonging to the scanning lines $S_{2n}$ at the selection of the scanning line $S_{2n}$. As discussed earlier, if the writing discharge is not reliably generated, some disadvantages in image display such as not-lighting are caused in the sustain period ST.

In the writing period O2 of the driving method shown in FIG. 2, when the writing discharge is generated in the discharge cell belonging to the selected odd-numbered scanning line $S_{2n-1}$, the voltages H and L are applied to the sustain discharge electrodes $J_{2n-1}$ and $J_{2n}$ defining the scanning line $S_{2n-1}$, respectively. Therefore, with the writing discharge, the negative charges are normally accumulated above the sustain discharge electrode $J_{2n-1}$ and the positive charges are normally accumulated above the sustain discharge electrode $J_{2n}$.

After that, when the voltage at the sustain discharge electrode $J_{2n-1}$ is switched to the voltage L at the selection of the next scanning line $S_{2n-3}$, a voltage with the normal negative charges accumulated above the sustain discharge electrode $J_{2n-1}$ is superimposed on the voltage L and the negative charges serve to enhance the electric field produced by the sustain discharge electrode $J_{2n-1}$. Therefore, after the voltage at the sustain discharge electrode $J_{2n-1}$ is switched to the voltage L, when the voltage Von is applied to the address electrode 22 according to the selection of another scanning line S, an opposite discharge is sometimes generated unintentionally between the sustain discharge electrode $J_{2n-1}$ and the address electrode 22.

Such an unintentional opposite discharge reduces the negative charges normally accumulated above the sustain discharge electrode $J_{2n-1}$. In this case, when there remains not enough negative charges to generate the sustain discharge in the sustain period ST, some disadvantages in image display such as not-lighting may be caused.

Then, in the third preferred embodiment, a driving method by which the unnecessary opposite discharge and unintentional opposite discharge can be reduced to enhance the display quality.

Figure 6:
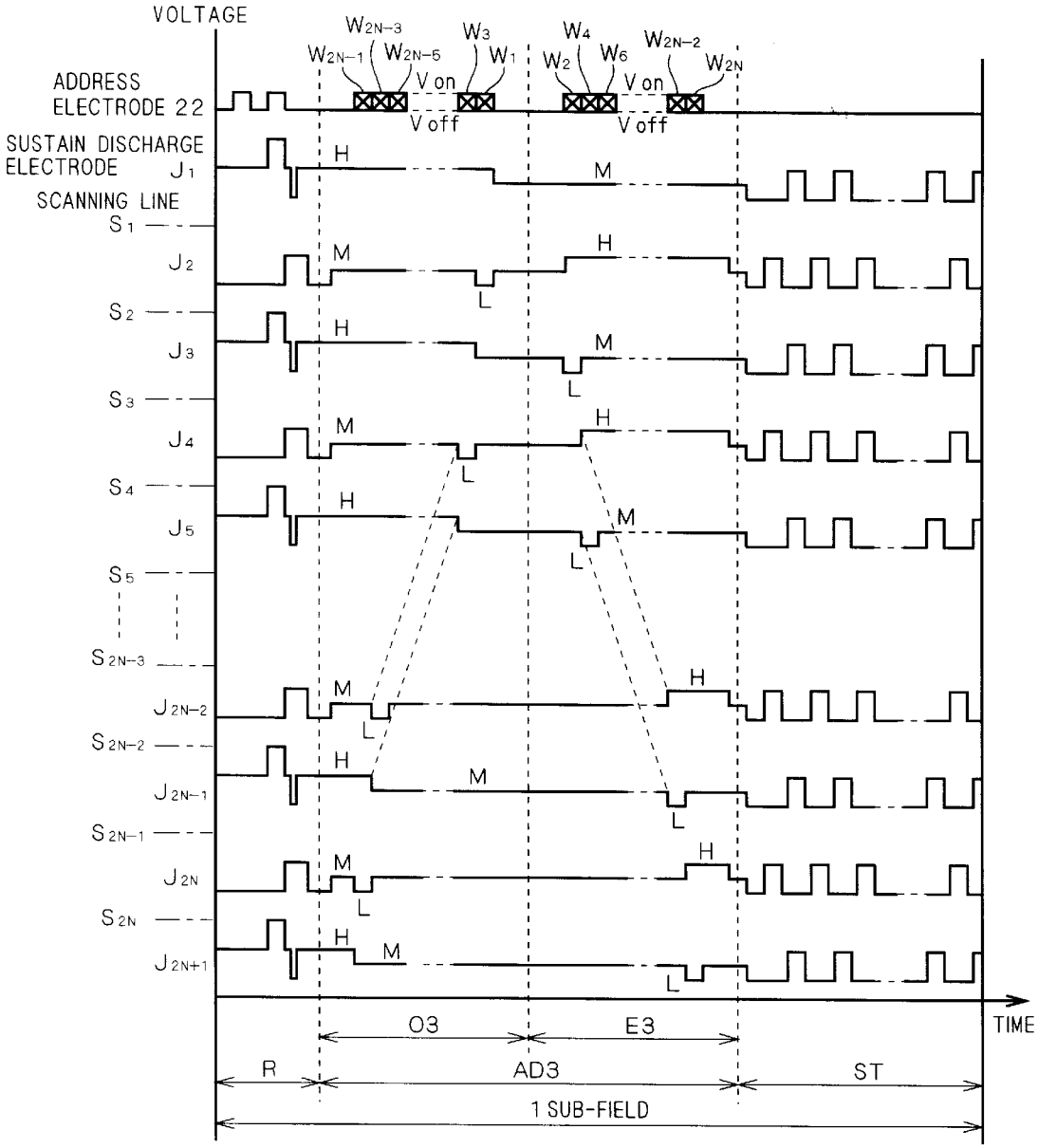
FIG. 6 is a timing chart used for an explanation of a method of driving an AC-type PDP in accordance with a third preferred embodiment of the present invention.

FIG. 6 is a timing chart used for an explanation of a driving method in accordance with the third preferred embodiment of the present invention. FIG. 6 shows a voltage sequence for one sub-field of the voltages applied to the address electrode 22 and the sustain discharge electrodes J. The characteristic feature of the driving method of the third preferred embodiment lies in the driving method in the writing period AD3 and this point will be mainly discussed. The earlier-discussed voltage sequence can be used for the reset period R and the sustain period ST.

The writing period AD3 consists of an odd-numbered scanning-line writing period O3 and an even-numbered scanning-line writing period E3. As an exemplary case where the writing period O3 is executed first and the writing period E3 is thereafter executed will be discussed herein, but the order of execution of the writing period O3 and E3 may be changed over.

In the driving method of the third preferred embodiment, particularly, used is a voltage (value) M for inhibiting generation of the writing discharge (discharge inhibition voltage). This voltage M has a value between the values of the voltage H and the voltage L. More specifically, the voltage M has a value not to generate any opposite discharge (in this case, writing discharge) between the address electrode 22 and the sustain discharge electrode J to which the voltage M is applied even when the voltage Von is applied to the address electrode 22. FIG. 6 shows, as an example, a case where the voltage M has an intermediate value between the values of the voltage H and the voltage L.

First, in the writing period O3, before the start of the scanning of the odd-numbered scanning lines S, the voltages at all the odd-numbered sustain discharge electrodes J are set to the voltage H and the voltages at all the even-numbered sustain discharge electrodes J are set to the voltage M. Then, when the odd-numbered scanning lines $S_{2n-1}$ are selected in descending order, the voltages at the adjacent sustain discharge electrodes $J_{2n+1}$ and $J_{2n}$ are switched to the voltages M and L, respectively, and at the same time, the voltages at the sustain discharge electrodes $J_{2n+2}$ which are switched to the voltage L at the selection of the immediately-preceding scanning lines $S_{2n+1}$ are switched to the voltage M. According to such a voltage sequence, the voltage M is applied to all the sustain discharge electrodes J at the end of the selection of the scanning line $S_1$.

In the subsequent writing period E3, when the even-numbered scanning lines $S_{2n}$ are selected in ascending order, the voltages at the adjacent sustain discharge electrodes $J_{2n}$ and $J_{2n+1}$ are switched to the voltages H and L, respectively, and at the same time, the voltages at the sustain discharge electrodes $J_{2n-1}$, which are switched to the voltage L at the selection of the immediately-preceding scanning lines $S_{2n-2}$ are switched to the voltage M. According to such a voltage sequence, the voltage M is applied to all the odd-numbered sustain discharge electrodes $J_{2n-1}$ and the voltage H is applied to all the even-numbered sustain discharge electrodes $J_{2n}$ at the end of the selection of the scanning line $S_{2N}$. After that, the voltages at the even-numbered sustain discharge electrodes $J_{2n}$ are switched to the voltage M and the writing period E3 is completed with the voltage M applied to all the sustain discharge electrodes J.

In the subsequent sustain period ST, after switching the voltages at all the sustain discharge electrodes J to the voltage L, a predetermined sustain pulse is applied thereto. Further, there may be another case where the voltages at the sustain discharge electrodes J are switched to the voltage H and the sustain period starts with a reversed one of the sustain pulse of FIG. 6, like in the sustain period STa shown in FIG. 3 discussed earlier.

The driving method of the third preferred embodiment can produce the following effects as well as the effects of the driving methods of the first and second preferred embodiments.

In the driving method of the third preferred embodiment, the voltage M is applied to the sustain discharge electrode $J_{2n+1}$ after the selection of a predetermined scanning line S in the writing period O3. Therefore, after the voltage at sustain discharge electrode $J_{2n+1}$ is switched from the voltage H to the voltage M, when the voltage Von is applied to the address electrode 22 while the scanning proceeds in the order of the scanning line $S_{2n}$, scanning line $S_{2n-3}$, . . . , the scanning line $S_3$, the scanning line $S_1$, the scanning line $S_2$, the scanning line $S_4$, . . . , the scanning line $S_{2n-2}$, no unnecessary opposite discharge is generated between the sustain discharge electrode $J_{2n+1}$ and the address electrode 22.

Further, since the voltage M is applied to the sustain discharge electrode $J_{2n-1}$ after the selection of the scanning line $S_{2n-1}$, even when the normal negative charges are accumulated above the sustain discharge electrode $J_{2n-1}$ in the discharge cell belonging to the scanning line $S_{2n-1}$ which has been selected by performing the writing operation, it is possible to inhibit the opposite discharge from being unintentionally generated by the negative charges between the sustain discharge electrode $J_{2n-1}$ and the address electrode 22.

As a result, disadvantages such as not-lighting can be reduced and image display of higher quality can be achieved as compared with the driving method shown in FIG. 2.

In adopting a voltage sequence, where the voltage L is applied to the sustain discharge electrode only when the corresponding scanning line is selected in the writing period using the discharge inhibition voltage M as shown in FIG. 6, the voltage M is stationarily applied to the sustain discharge electrode $J_{2n}$ until the voltage L is applied while the voltage H is stationarily applied to the adjacent sustain discharge electrodes $J_{2n-1}$ and $J_{2n+1}$ in the writing period O3. Thus, when a stationary voltage (the voltage H−the voltage M) works between the adjacent sustain discharge electrodes, generally, the migration may be generated between the adjacent sustain discharge electrodes.

In the following writing period E3, however, after applying the voltage L to the sustain discharge electrode $J_{2n+1}$, the voltage M is stationarily applied to the sustain discharge electrode $J_{2n+1}$ and the voltage H is stationarily applied to the adjacent sustain discharge electrodes $J_{2n+1}$ and $J_{2n+2}$. Therefore, in the writing period AD3 the stationary voltage (the voltage H−the voltage M) working between the adjacent sustain discharge electrodes in the writing period O3 and that in the writing period E3 have vectors reverse to each other, working for the same time. Therefore, through the writing period AD3 the voltages working between the adjacent sustain discharge electrodes are bidirectional in polarity, keeping the balance. Accordingly, the migration is so scarcely generated.

Thus, the reason why the generation of migration can be suppressed in the writing period by the driving method of the third preferred embodiment is as follows. Specifically, when the adjacent two scanning lines sharing one sustain discharge electrode are selected exclusively to each other in the writing period, the voltages applied to the shared sustain discharge electrode are reverse in polarity to each other, like in the driving method of the second preferred embodiment.

Assuming that the discharge inhibition voltage M is used in the writing period AD1 of the first preferred embodiment shown in FIG. 1 to stabilize the operation of the writing discharge, the voltage L applied to the odd-numbered sustain discharge electrodes $J_{2n-1}$ is replaced by the voltage M and the voltage applied to the even-numbered sustain discharge electrodes $J_{2n}$ is basically the voltage M and switched to the voltage L only when the corresponding scanning line is selected. In this case, through the writing period on all the scanning lines, the stationary voltages (the voltage H−the voltage M) working between the adjacent sustain discharge electrodes during a predetermined period become unidirectional in polarity in any case of adjacent sustain discharge electrodes. Therefore, the migration is likely to occur.

Further, keeping the relation of the voltage H>the voltage M>the voltage L, the voltage M applied to the odd-numbered sustain discharge electrodes $J_{2n-1}$ in the writing period E3 and the voltage M applied to the even-numbered sustain discharge electrodes $J_{2n}$, in the writing period O3 may have different values. For example, the voltage M applied to the odd-numbered sustain discharge electrodes $J_{2n-1}$ is set to a value mainly to inhibit the unnecessary opposite discharge while the voltage M applied to the even-numbered sustain discharge electrodes $J_{2n}$ is set to a value mainly to inhibit the unintentional opposite discharge.

The driving method of the third preferred embodiment needs three voltage values H, M and L in the writing period AD3. Therefore, if a circuit for supplying the sustain discharge electrode J with a predetermined voltage (in general, being integrated and termed a driver IC) has a configuration in which the three voltages H, M and L are simply inputted and switched to be outputted to the sustain discharge electrode J, the circuit configuration becomes more complicated than that of the circuit applied to the earlier-discussed driving method shown in FIG. 1 or the like, in which the two voltages H and L are switched and outputted.

Figure 7:
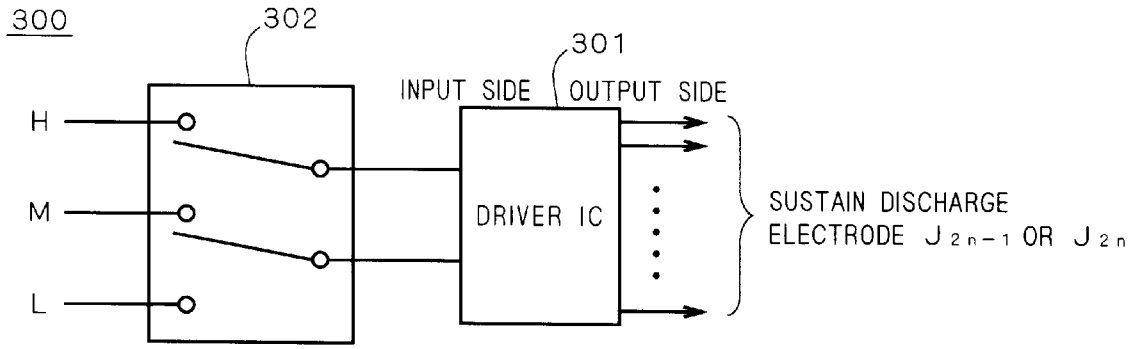
FIG. 7 is a block diagram showing a voltage supply circuit for supplying a sustain discharge electrode with a voltage, which is applied to the driving method in accordance with the third preferred embodiment of the present invention.

Then, a voltage supply circuit for supplying the sustain discharge electrode J with a voltage, which is suitable for the driving method shown in FIG. 6, will be discussed. FIG. 7 is a block diagram of the circuit. A voltage supply circuit 300 of FIG. 7 is included in the driving device 201 and comprises a selector switch 302 between the input side of a driver IC 301 and (respective power supplies of) the voltages H, M and L. The selector switch 302 receives the three voltages H, M and L and selectively transmits two voltages among these three voltages to the driver IC 301. Then, to each sustain discharge electrode J, the driver IC 301 applies one of the two inputted voltages which should be applied to the sustain discharge electrode J.

Two voltage supply circuits 300 for the odd-numbered sustain discharge electrode and the even-numbered sustain discharge electrode are provided, to perform the driving method shown in FIG. 6. In detail, the voltage supply circuit 300 for the odd-numbered sustain discharge electrode has a configuration to transmit the two voltages H and M to the driver IC 301 in the writing period O3 and to transmit the two voltages M and L to the driver IC 301 in the writing period E3 by controlling the selector switch 302. On the other hand, the voltage supply circuit 300 for the even-numbered sustain discharge electrode has a configuration to transmit the two voltages M and L to the driver IC 301 in the writing period O3 and to transmit the two voltages H and M to the driver IC 301 in the writing period E3.

Thus, by switching the voltages inputted to the driver IC 301 every a predetermined period, a driver IC which is the same as the above-discussed driver IC for switching the two voltages H and L to be outputted can be used as the driver IC 301 of the voltage supply circuit 300. Specifically, with a simple change of the circuit by adding the selector switch 302 to the driver IC applied to the driving method shown FIG. 1 or the like, the driving method shown in FIG. 6 can be performed.

<The First Variation of The Third Preferred Embodiment>

Figure 8:
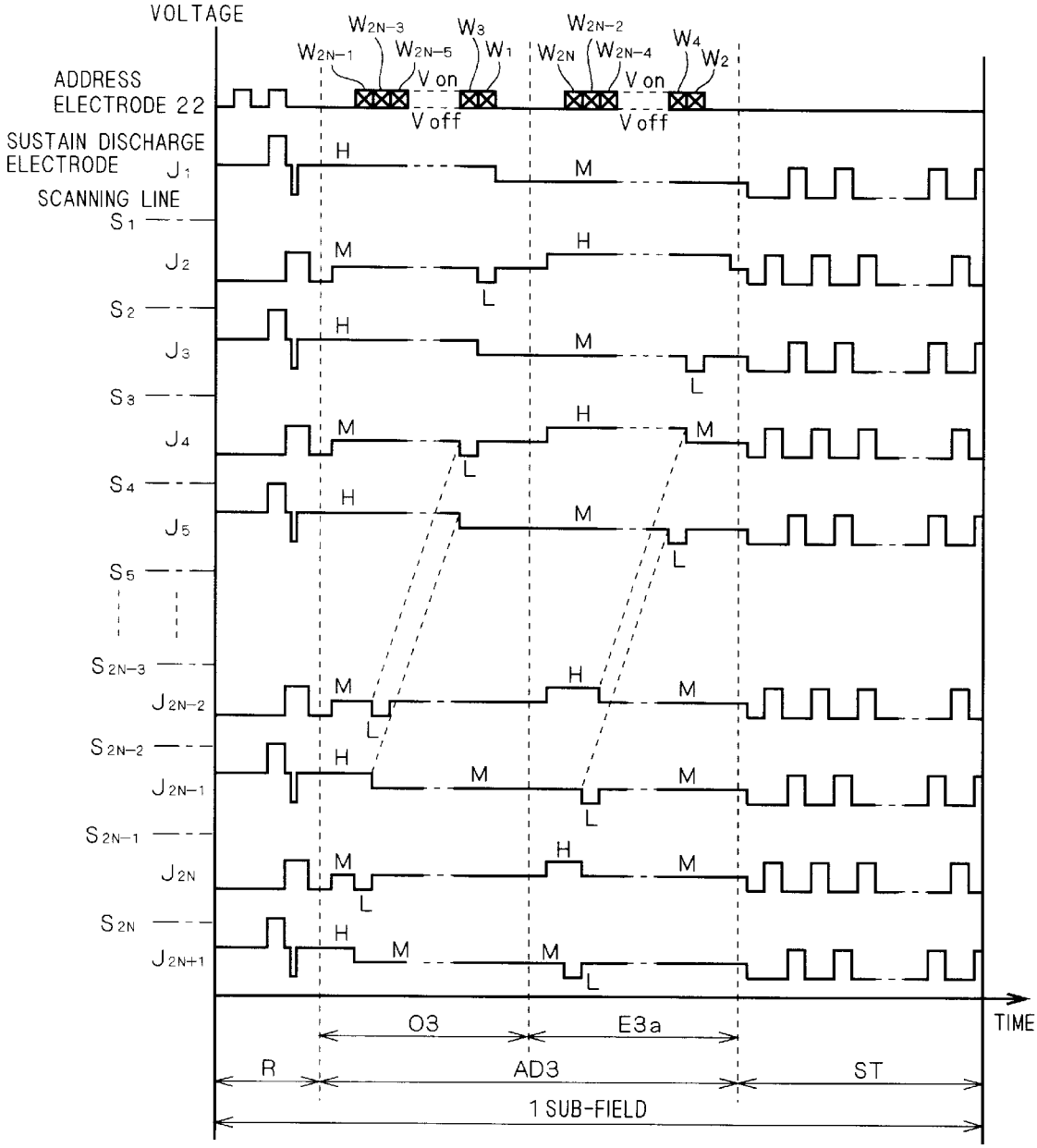
FIG. 8 is a timing chart used for an explanation of a method of driving an AC-type PDP in accordance with a first variation of the third preferred embodiment of the present invention.

FIG. 8 is a timing chart used for an explanation of a driving method in accordance with the first variation of the third preferred embodiment. The timing chart of FIG. 8 is the same as that of FIG. 6 except for a voltage sequence in the even-numbered scanning-line writing period E3*a*.

In the writing period E3*a* of the driving method of the first variation of the third preferred embodiment, before the start of the scanning, the voltages at the odd-numbered sustain discharge electrodes J are set to the voltage M and the voltages at the even-numbered sustain discharge electrodes J are set to the voltage H. After that, the even-numbered scanning lines S are scanned in descending order. Specifically, in synchronization with the timing of application of the image data $W_{2n}$ to the address electrode 22, the voltages at the sustain discharge electrodes $J_{2n+2}$ and $J_{2n+1}$ are switched to the voltages M and L, respectively, and at the same time, the voltage at the sustain discharge electrode $J_{2n+3}$ which is switched to the voltage L at the selection of the immediately-preceding scanning line is switched to the voltage M. With this operation, the voltages H and L are applied to the sustain discharge electrodes $J_{2n}$ and $J_{2n+1}$ defining the scanning lines $S_{2n}$.

The driving method of the first variation of the third preferred embodiment can produce the following effects as well as the effects of that of the third preferred embodiment. Specifically, since the voltages at the even-numbered sustain discharge electrodes $J_{2n}$ are set to the voltage H before the start of the scanning, it is not necessary to switch the voltages at the sustain discharge electrodes $J_{2n}$ at the selection of the scanning lines $S_{2n}$. Therefore, the start timing of the writing discharge is not defined by the voltage change, or the rise and fall of the pulse, of both sustain discharge electrodes defining the selected scanning line $S_{2n}$, unlike in the writing period E3 shown in FIG. 6, but defined by the time to switch the voltage at the sustain discharge electrode $J_{2n+1}$ from the voltage M to the voltage L. As a result, the response of the generation of the writing discharge becomes faster and the writing discharge can be generated with more reliability as compared with the writing period E3 shown in FIG. 6.

<The Fourth Preferred Embodiment>

In the above-discussed writing period O3, the negative and positive charges are normally accumulated on the exposed portion of the cathode film 11 in the discharge cell belonging to the odd-numbered scanning line $S_{2n-1}$, i.e., above the sustain discharge electrodes $J_{2n-1}$ and $J_{2n}$, respectively, selectively according to the image data W. When the writing period O3 with this state is immediately shifted to the writing period E3, the writing discharge may sometimes become unstable in the writing period E3. The reason of this unstable writing discharge is as follows. In the writing period E3, when the voltage at the sustain discharge electrode $J_{2n}$ is switched from the voltage M to the voltage H to select the even-numbered scanning line $S_{2n}$, the surface discharge may be sometimes generated between the sustain discharge electrodes $J_{2n-1}$, and the $J_{2n}$ in the scanning line $S_{2n-1}$ adjacent to the scanning line $S_{2n}$, sharing the sustain discharge electrode $J_{2n}$. With a priming effect by the surface discharge, an irregular writing discharge or an unintentional writing discharge may be induced in the discharge cell belonging to the address electrode 22 to which the voltage Voff is applied among the discharge cells belonging to the selected scanning line $S_{2n}$, to make the writing discharge unstable. Such an unintentional writing discharge causes disadvantage in image display such as not-lighting in the sustain period ST.

The above-discussed surface discharge inducing the unintentional writing discharge is generated by superimposing the electric field produced by the voltages M and H applied to the sustain discharge electrodes $J_{2n-1}$ and $J_{2n}$ in the writing period E3 on the electric field produced by the negative and positive charges accumulated above the sustain discharge electrodes $J_{2n-1}$ and $J_{2n}$ in the preceding writing period O3.

In this case, by raising the voltage value M to reduce the voltage difference between the voltages M and H, the above generation of the surface discharge can be suppressed to some degree. If the voltage value M is set higher, however, when the voltage L is applied to the sustain discharge electrode $J_{2n-1}$, the unintentional discharge may be sometimes generated between the sustain discharge electrode $J_{2n-1}$ to which the voltage L is applied and the sustain discharge electrode $J_{2n}$ to which the voltage M is applied i.e., in the scanning line $S_{2n-1}$.

Then, in the fourth preferred embodiment, discussion will be made on a driving method by which the above unintentional writing discharge can be suppressed/removed.

Figure 9:
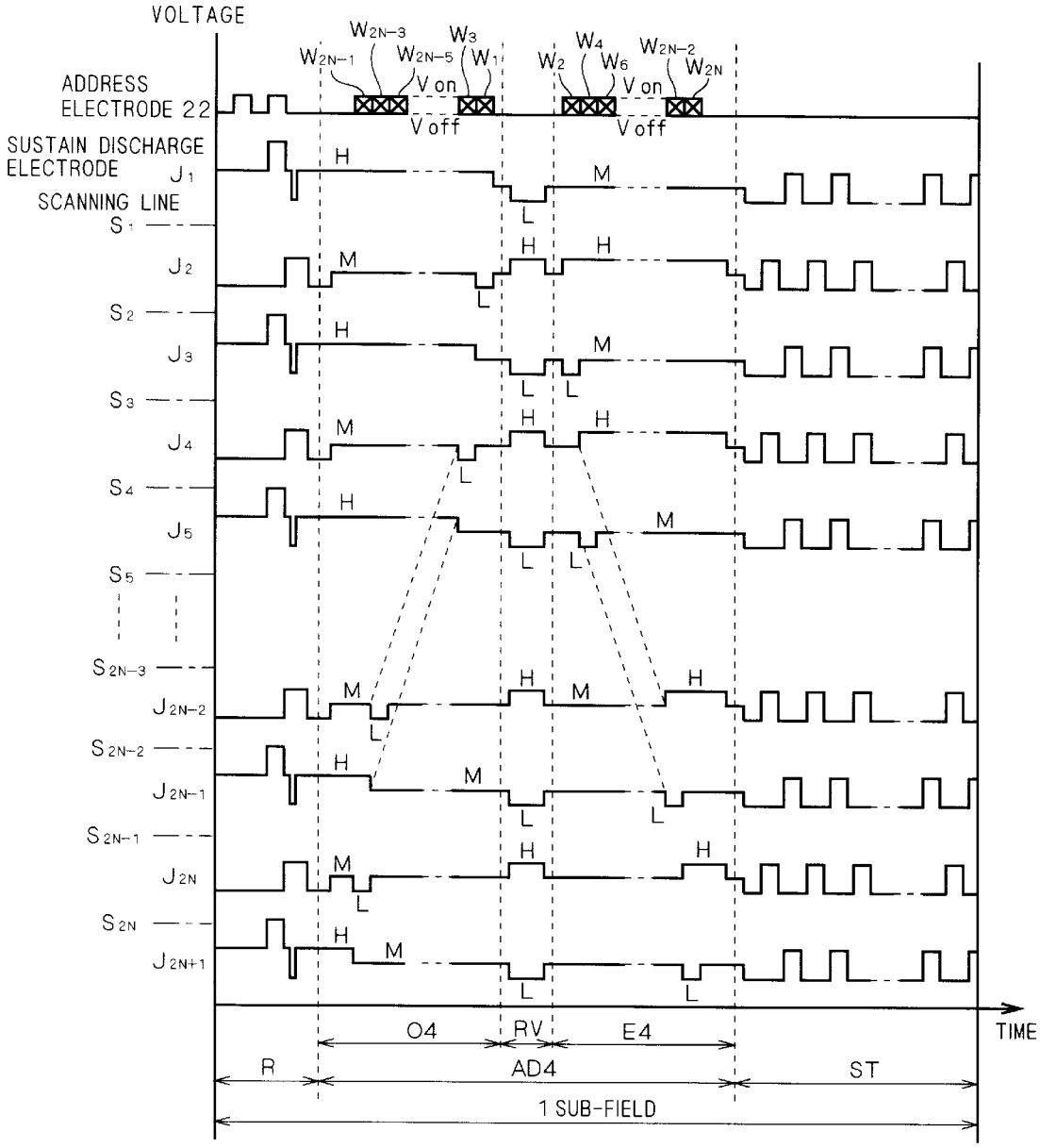
FIG. 9 is a timing chart used for an explanation of a method of driving an AC-type PDP in accordance with a fourth preferred embodiment of the present invention.

FIG. 9 is a timing chart used for an explanation of a driving method in accordance with the fourth preferred embodiment of the present invention. FIG. 9 shows a voltage sequence for one sub-field of the voltages applied to the address electrode 22 and the sustain discharge electrodes J. The characteristic feature of the driving method of the fourth preferred embodiment lies in the driving method in the writing period AD4 and this point will be mainly discussed. The earlier-discussed voltage sequence can be used for the reset period R and the sustain period ST.

The writing period AD4 consists of an odd-numbered scanning-line writing period O4, an even-numbered scanning-line writing period E4 and a polarity reverse period RV between the writing periods O4 and E4. As an example, discussion will be made on a case where the writing periods O3 and E3 are herein used as the writing periods O4 and E4 and the writing period O4 is first executed and the writing period E4 is thereafter executed.

In the polarity reverse period RV, particularly, the voltage Voff is applied to all the address electrodes 22 and the following voltages are applied to the sustain discharge electrodes $J_n$. First, the voltages applied to all the odd-numbered sustain discharge electrodes J are switched from the voltage M to the voltage L simultaneously, and at the same time, the voltages applied to all the even-numbered sustain discharge electrodes J are switched from the voltage M to the voltage H simultaneously. After that, the voltages applied to all the even-numbered sustain discharge electrodes J are returned to the voltage M simultaneously, and at the same time, the voltages applied to all the odd-numbered sustain discharge electrodes J are returned to the voltage M simultaneously.

The switching of the voltages at the odd-numbered and even-numbered sustain discharge electrodes $J_{2n-1}$ and $J_{2n}$ to the voltages L and H, respectively, in the polarity reverse period RV is reverse in polarity to the application of the voltages H and L to the sustain discharge electrodes $J_{2n-1}$ and $J_{2n}$ to select the odd-numbered scanning lines $S_{2n-1}$ in the writing period O4. In the discharge cells in which the writing operation is performed in the writing period O4, the negative and positive charges are normally accumulated on the exposed portion of the cathode film 11, i.e., above the sustain discharge electrodes $J_{2n-1}$ and $J_{2n}$, respectively. At this time, the surface discharge is generated between the sustain discharge electrodes $J_{2n-1}$ and $J_{2n}$ by superimposing the electric field produced by the voltages L and H applied to the sustain discharge electrodes $J_{2nh-1}$, and $J_{2n}$, respectively, in the polarity reverse period RV on the electric field produced by the wall charges or accumulated charges above the sustain discharge electrodes $J_{2n-1}$ and $J_{2n}$.

The surface discharge is completed, reversing the polarity of the electric charges generated and accumulated by the writing discharge above the sustain discharge electrode J belonging to the discharge cell in which the writing discharge is generated among the discharge cells belonging to the odd-numbered scanning line $S_{2n-1}$ before the execution of the polarity reverse period RV, i.e., the end of the preceding writing period O4. Specifically, the positive charges are accumulated on the exposed portion of the cathode film 11 in the discharge cell, i.e., above the sustain discharge electrode $J_{2n-1}$ to which the voltage L is applied and the negative charges are accumulated above the sustain discharge electrode $J_{2n}$ to which the voltage H is applied.

After that, the voltage at the sustain discharge electrodes $J_{2n-1}$ and $J_{2n}$ are switched to the voltage M and the subsequent writing period E4 is executed.

The driving method of the fourth preferred embodiment can produce the following effects as well as the effects of the driving methods of the third preferred embodiment. Specifically, at the end of the polarity reverse period RV, i.e., before the start of the following writing period E4, the positive charges are accumulated on the exposed portion of the cathode film 11 in the discharge cell belonging to the scanning line $S_{2n-1}$, i.e., above the sustain discharge electrode $J_{2n-1}$ and the negative charges are accumulated above the sustain discharge electrode $J_{2n}$. For this reason, also when the voltages at the sustain discharge electrodes $J_{2n}$ are switched from the voltage M to the voltage H to select the even-numbered scanning lines $S_{2n}$ in the following writing period E4, the voltages M and H applied to the sustain discharge electrodes $J_{2n-1}$ and $J_{2n}$, respectively, and the accumulated charges above the sustain discharge electrodes $J_{2n-1}$ and $J_{2n}$ can be made reverse in polarity to each other.

Therefore, in the writing period E4, it is possible to remarkably suppress generation of the surface discharge between the sustain discharge electrodes $J_{2n-1}$ and $J_{2n}$ in the scanning line $S_{2n-1}$ adjacent to the selected scanning line $S_{2n}$ with the sustain discharge electrode $J_{2n}$ interposed therebetween. As a result, even when the voltage Voff is applied to the address electrode 22 at the selection of the scanning line $S_{2n}$, it is possible to remarkably suppress generation of the unintentional writing discharge in the scanning line $S_{2n}$. This makes it possible to reduce the disadvantages such as not-lighting and achieve an image display of higher quality as compared with the driving method shown in FIG. 2.

<The First Variation of The Fourth Preferred Embodiment>

Figure 10:
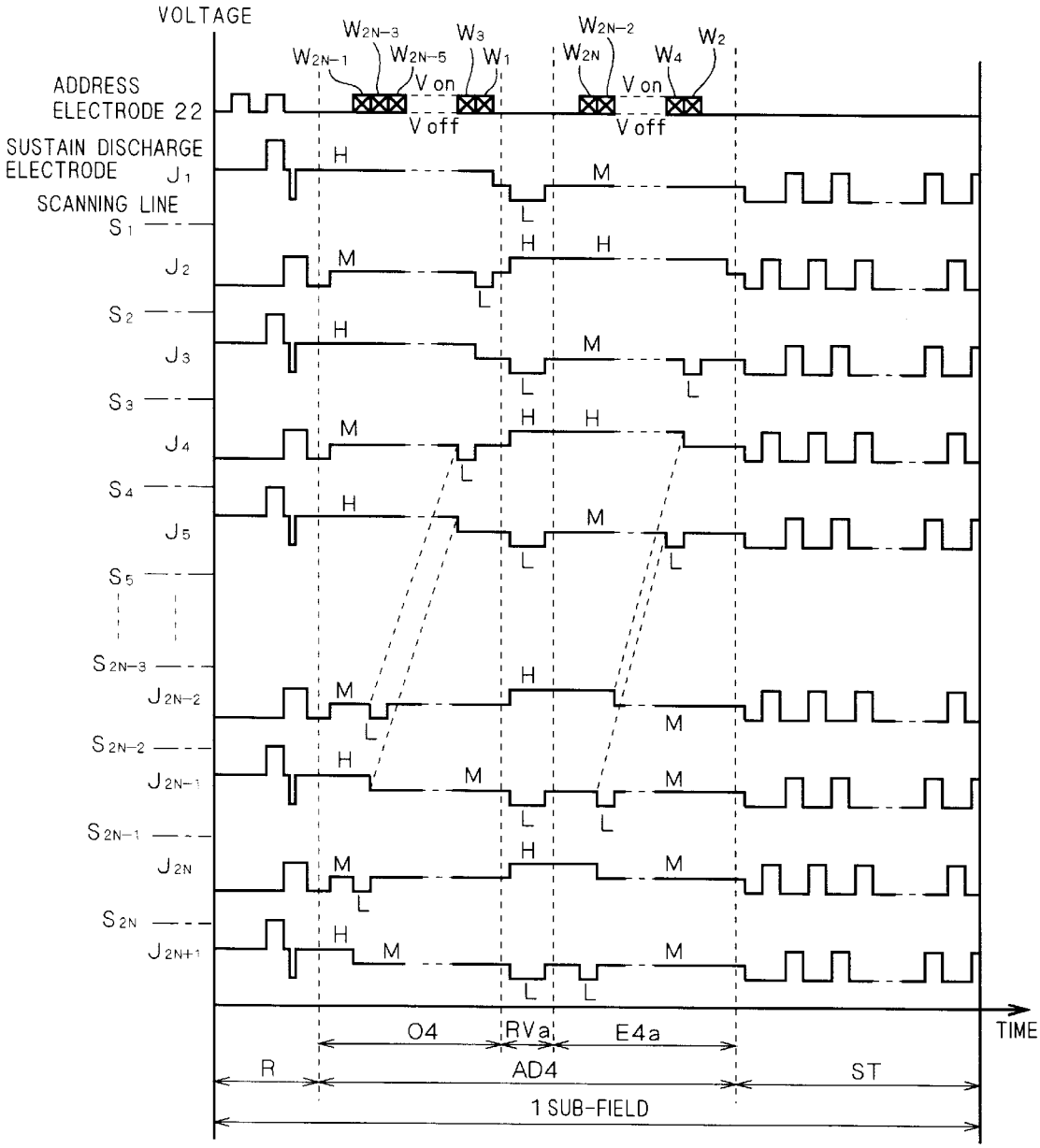
FIG. 10 is a timing chart used for an explanation of a method of driving an AC-type PDP in accordance with a first variation of the fourth preferred embodiment of the present invention.

FIG. 10 is a timing chart used for an explanation of a driving method in accordance with the first variation of the fourth preferred embodiment. The timing chart of FIG. 10 is the same as that of FIG. 9 except for voltage sequences in a polarity reverse period RVa and a writing period E4*a*.

In the polarity reverse period RVa of the driving method of the first variation of the fourth preferred embodiment, like in the polarity reverse period RV shown in FIG. 9, the voltages at all the odd-numbered and even-numbered sustain discharge electrodes J are switched from the voltage M to the voltage L and H, respectively. After that, the voltages at all the odd-numbered sustain discharge electrodes J are switched to the voltage M while the voltages applied to all the even-numbered sustain discharge electrodes J remains set at the voltage H, unlike in the polarity reverse period RV shown in FIG. 9.

Then, the following writing period E4*a* starts with the voltages M and H applied to the sustain discharge electrodes $J_{2n-1}$ and $J_{2n}$, respectively. In the writing period E4*a,* like in the above-discussed writing period E3*a* (see FIG. 8), the even-numbered scanning lines S are scanned in descending order. In other words, a voltage sequence which is the same as that in the writing period E3*a* can be used as that in the writing period E4*a* except for the voltages applied to the sustain discharge electrodes J before the start of the scanning in the writing period E4*a*.

The driving method of the first variation of the fourth preferred embodiment can produce the effects of the fourth preferred embodiment.

<The Fifth Preferred Embodiment>

Figure 11:
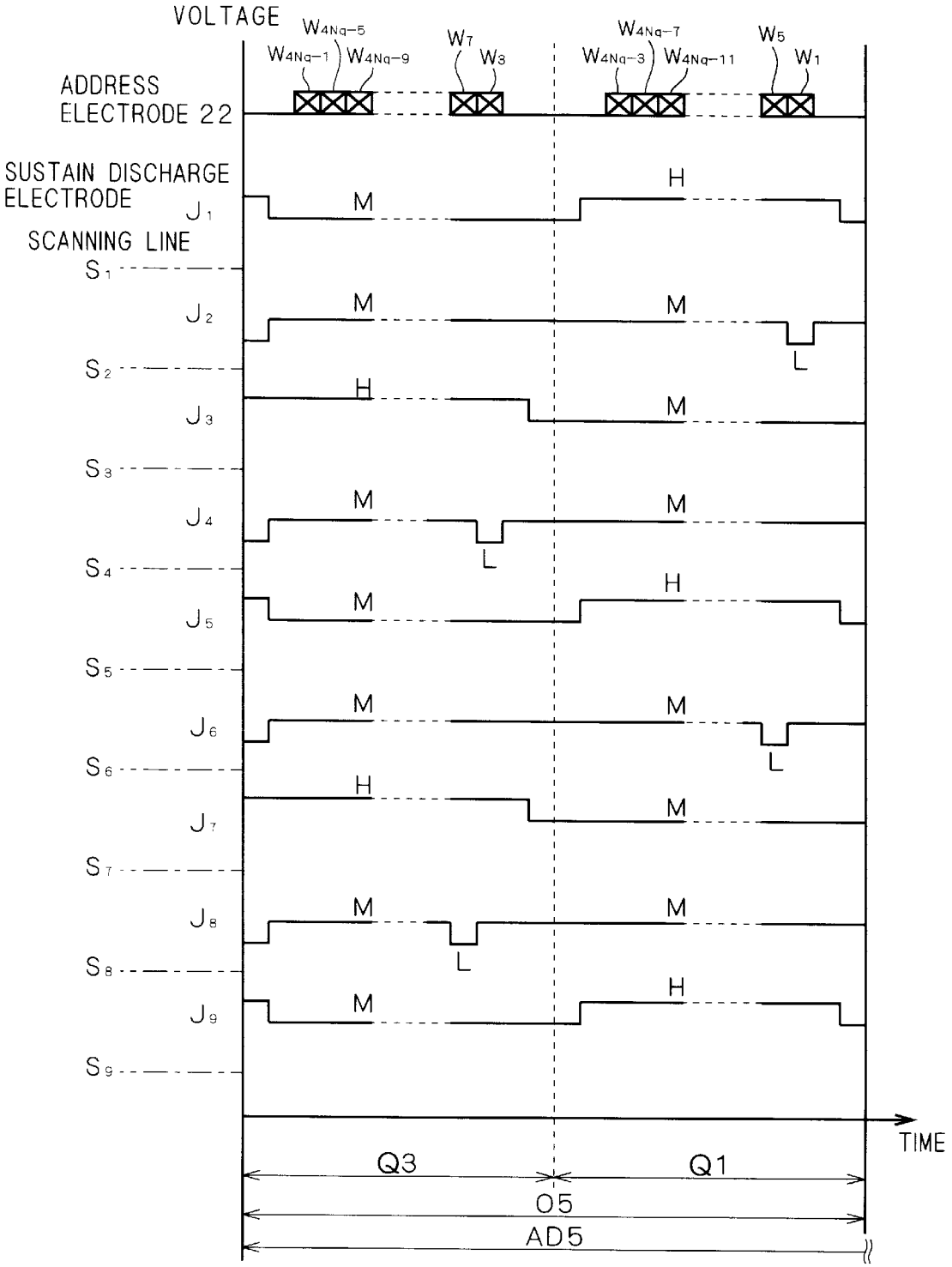
FIGS. 11 to 14 are timing charts used for an explanation of a method of driving an AC-type PDP in accordance with a fifth preferred embodiment of the present invention.
Figure 12:
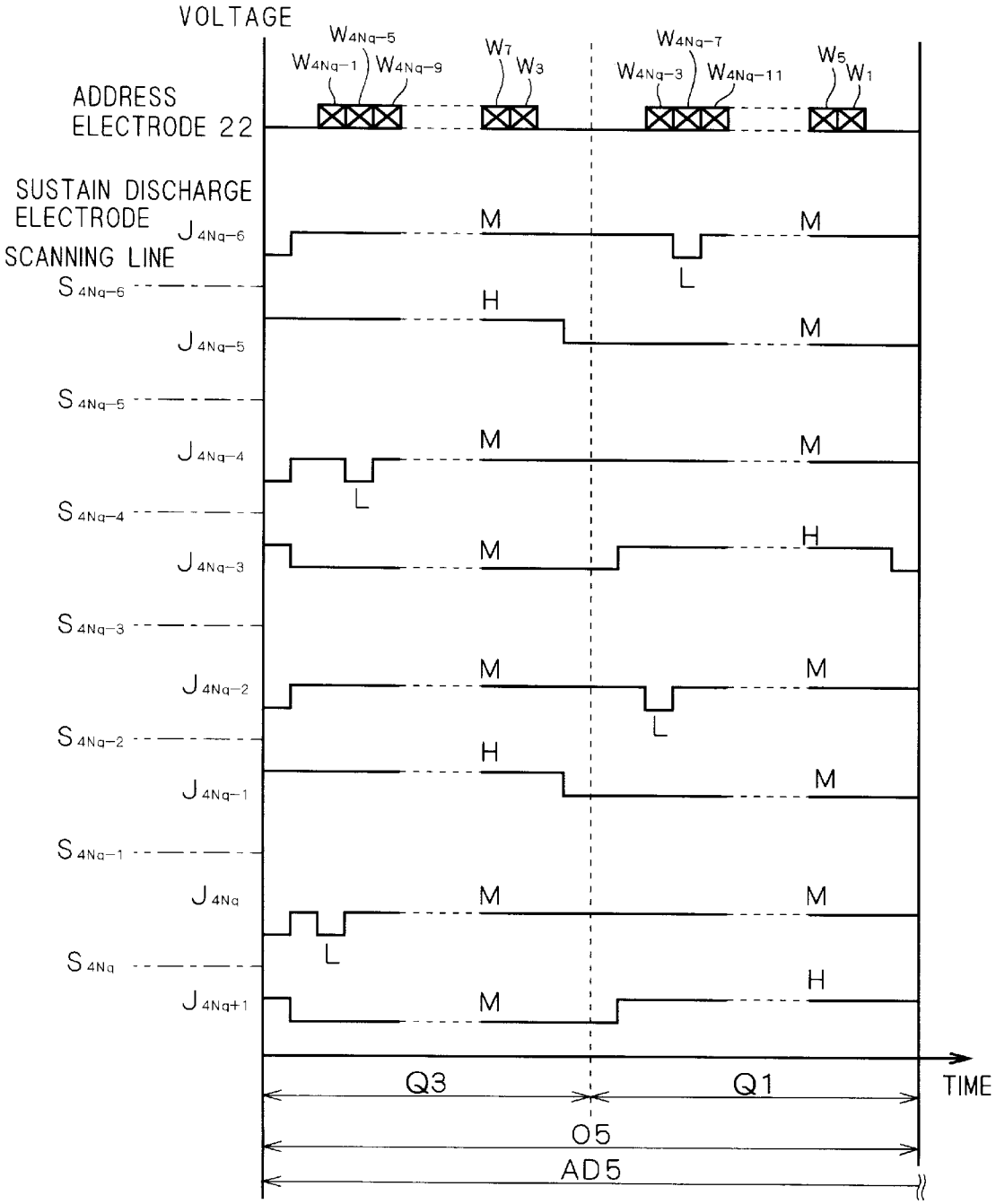
Figure 13:
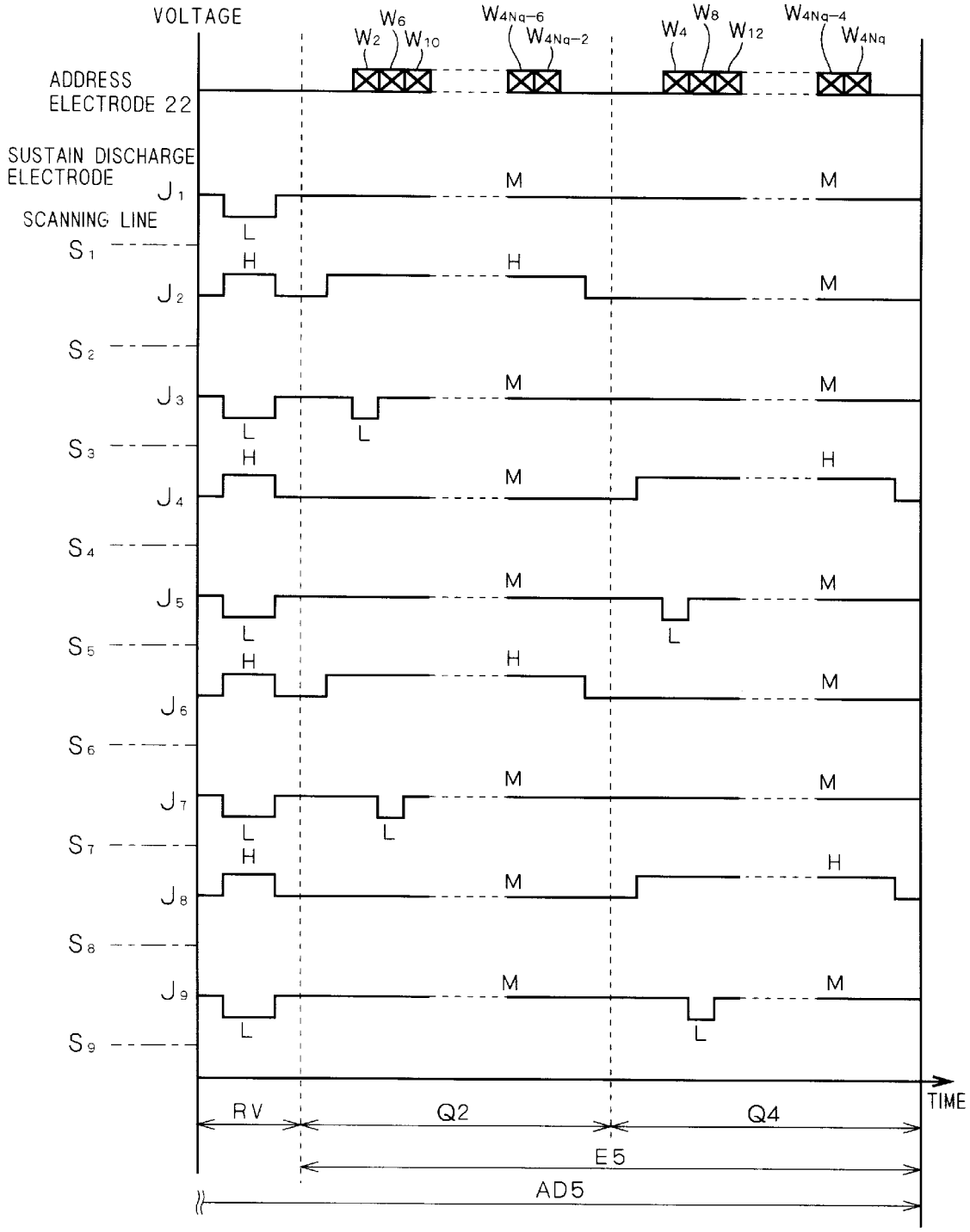
Figure 14:
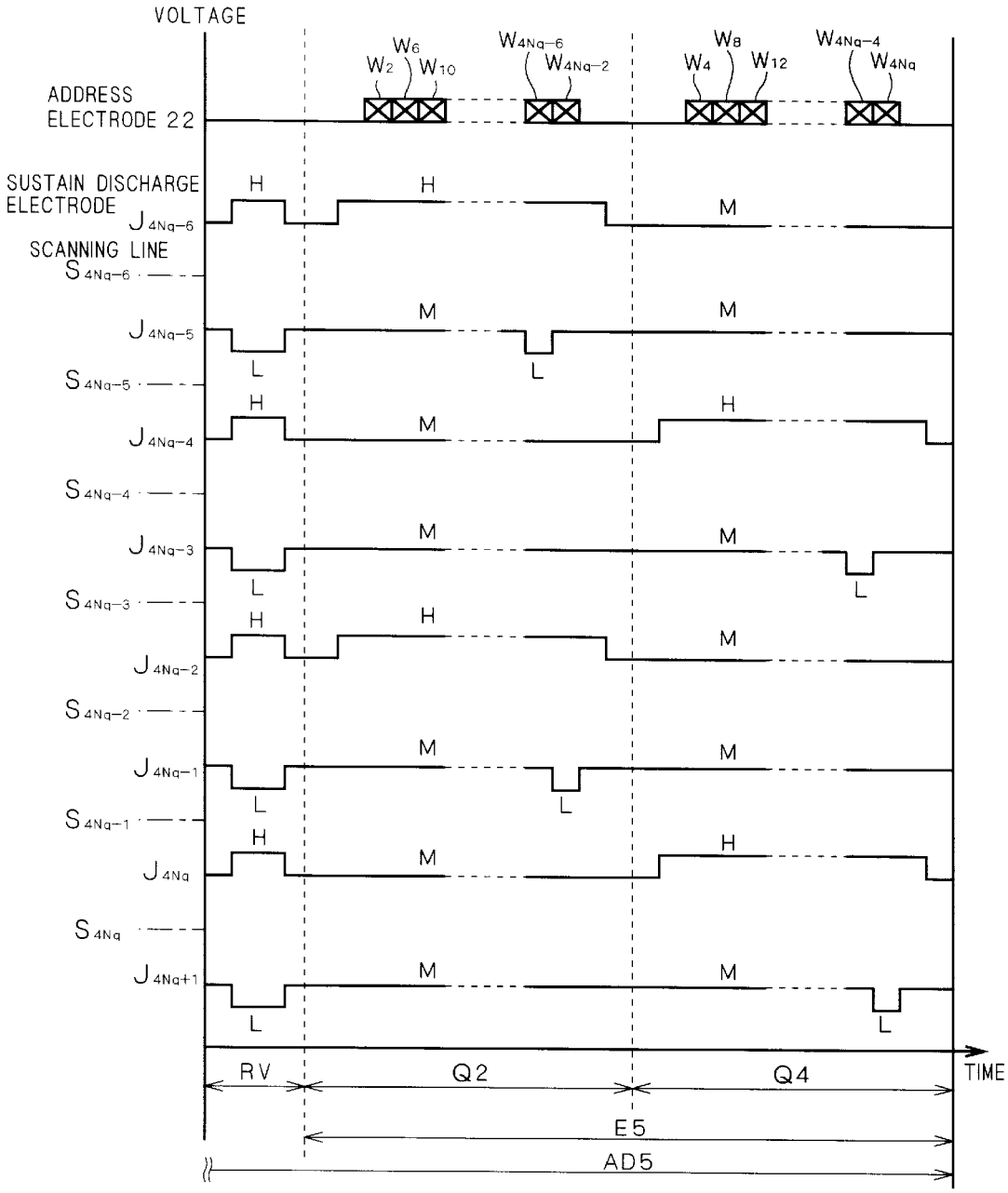

FIGS. 11 to 14 are timing charts used for an explanation of a driving method in accordance with the fifth preferred embodiment of the present invention. Since the above-discussed reset period R and sustain period ST can be used as the reset period and the sustain period in the driving method of the fifth preferred embodiment, the reset period and the sustain period are not shown and only the writing period AD5 is shown in FIGS. 11 to 14. For convenience of illustration, it is assumed that the total number of sustain discharge electrodes J is (4Nq+1) and the total number of scanning lines S is 4Nq. Further, to avoid complication of illustration, voltage sequences for the sustain discharge electrodes $J_1$ to $J_9$ are shown in FIGS. 11 and 13 and those of the sustain discharge electrodes $J_{4Nq-6}$ to $J_{4Nq+1}$ are shown in FIGS. 12 and 14.

The writing period AD5 has a writing period O5 for the odd-numbered scanning lines S (see FIGS. 11 and 12) and a writing period E5 for the even-numbered scanning lines S (see FIGS. 13 and 14) with the polarity reverse period RV (see FIGS. 13 and 14) therebetween.

In the driving method of the fifth preferred embodiment, particularly, the odd-numbered scanning-line writing period O5 is further divided into two writing periods Q3 and Q1. In detail, the writing period Q3 is executed on the scanning lines $S_3, S_7, \ldots, S_{4Nq-5}$ and $S_{4Nq-1}$ or on the scanning lines $S_{4k+3}$ ($0 \leqq k \leqq Nq-1$), and the writing period Q1 is executed on the scanning lines $S_1, S_5, \ldots, S_{4Nq-7}$ and $S_{4Nq-3}$ or on the scanning lines $S_{4k-1}$. Herein, discussion will be made on an exemplary case where the writing period Q3 for the scanning lines $S_{4k+3}$ is first executed and the writing period Q1 for the scanning lines $S_{4k+1}$ is thereafter executed.

Similarly, the even-numbered scanning-line writing period E5 is further divided into two writing periods Q2 and Q4. In detail, the writing period Q2 is executed on the scanning lines $S_2, S_6, \ldots, S_{4Nq-6}$ and $S_{4Nq-2}$ or on the scanning lines $S_{4k+2}$, and the writing period Q4 is executed on the scanning lines $S_4, S_8, \ldots, S_{4Nq-4}$ and $S_{4Nq}$ or on the scanning lines $S_{4k+4}$. Herein, discussion will be made on an exemplary case where the writing period Q2 for the scanning lines $S_{4k+2}$ is first executed and the writing period Q4 for the scanning lines $S_{4k+4}$ is thereafter executed.

In the driving method of the fifth preferred embodiment, the writing period AD5 or all the scanning lines S are divided into four groups and the following driving sequence is executed in the writing periods Qm (m=1, 2, 3 and 4).

As a specific example, a driving method in a case of m=3, i.e., the writing period Q3 for the scanning lines $S_{4k+3}$ will be discussed herein. First, before the start of the scanning in the writing period Q3, the voltages at the sustain discharge electrodes $J_{4k+3}$ are switched to the voltage H and the voltages at the sustain discharge electrodes $J_{4k+1}$, $J_{4k+2}$ and $J_{4k+4}$ are switched to the voltage M.

After that, the scanning lines $S_{4k+3}$ are selected in descending order. In detail, the voltage according to the image data $W_{4Nq-1}$ (corresponding to a case of k=Nq−1) is applied to the address electrode 22 and in synchronization with this application, the voltage at the sustain discharge electrode $J_{4Nq}$ is switched to the voltage L. With this operation selected is the scanning line $S_{4Nq-1}$ defined by the sustain discharge electrode $J_{4Nq}$ to which the voltage L is applied and its adjacent sustain discharge electrode $J_{4Nq-1}$ to which the voltage H is applied. Next, the voltage according to the image data $W_{4Nq-5}$ (corresponding to a case of k=Nq−2) is applied to the address electrode 22 and in synchronization with this application, the voltage at the sustain discharge electrode $J_{4Nq-4}$ is switched to the voltage L. With this operation, the scanning line $S_{4Nq-5}$ is selected. At this time, the voltage at the sustain discharge electrode $J_{4Nq}$ is switched to the voltage M. Similar voltage sequence is sequentially executed, to perform the scanning of up to the scanning line $S_3$ (corresponding to a case of k=0).

The same driving sequence is applied to the other writing periods Q1, Q2 and Q4. Specifically, in the writing period Qm for the scanning lines $S_{4k+m}$, the following voltages are applied to the address electrode 22 and the sustain discharge electrodes J.

The voltage Von or Voff according to the image data $W_{4k+m}$ is applied to the address electrode 22. To the sustain discharge electrodes $J_{4k+m}$ and $J_{4k+1}$ defining the scanning line $S_{4k+m}$ to be selected, the following voltages are applied. The voltage H is applied to the sustain discharge electrode $J_{4k+m}$ at least during the scanning. On the other hand, the voltage L is applied to the sustain discharge electrode $J_{4k+m+1}$ only while the scanning lines $S_{4k+m}$ defined by the sustain discharge electrode $J_{4k+m+1}$ should be selected and the voltage M is applied thereto during the other period. At this time, this application of the voltage L is performed in synchronization with the application of the voltage to the address electrode 22.

At this time, in the writing period Qm, the voltage M is applied to the sustain discharge electrodes $J_{4k+m-1}$ and $J_{4k+m+2}$ which are not related to the scanning at least during the scanning.

The driving method of the fifth preferred embodiment can produce the following effects as well as the effects of that of the above-discussed fourth preferred embodiment.

In the writing period Qm, continuous two of the four adjacent sustain discharge electrodes J are not related to the scanning in the writing period Qm. In other words, the two sustain discharge electrodes J related to the scanning are each sandwiched by the sustain discharge electrodes J not related to the scanning. Therefore, by continuously applying the voltage M to the sustain discharge electrodes J not related to the scanning, no unintentional writing discharge is generated in the scanning lines S not to be selected even if the voltage H or the voltage L is applied to the two sustain discharge electrodes J related to the scanning. Accordingly, it is possible to continuously apply the voltage H to one of the two sustain discharge electrodes J related to the scanning.

Therefore, by continuously applying the voltage H to the one of the sustain discharge electrodes J, the scanning line S can be selected only by switching the voltage applied to the other of the two sustain discharge electrodes J related to the scanning to the voltage L. Accordingly, like the driving method of the first variation of the third preferred embodiment, the response of generation of the writing discharge becomes faster and the writing discharge can be generated with more reliability.

At this time, since it is only necessary to switch the voltage at only one of the adjacent four sustain discharge electrodes J to the voltage L and it is only necessary to match the timing of switching the applied voltage to the voltage L and the timing of application of the image data W to the address electrode 22, the driving sequence becomes simpler than those in the earlier-discussed driving methods. Therefore, the load on the driving circuit or the driver IC can be reduced.

Though the scanning lines S are selected in ascending or descending order in the writing period Qm in the driving method shown in FIGS. 11 to 14, it is possible to arbitrarily set the selection order only if the image data W to be inputted to the address electrode 22 and the scanning line S to be selected correspond to each other. Further, the sustain discharge electrodes J to which the voltages H and L are applied, respectively, may be changed over.

Furthermore, in the writing period Qm, the voltage M to be applied to the sustain discharge electrode J related to the scanning and the voltage M to be applied to the sustain discharge electrode J not related to the scanning may be made different, keeping the relation of the voltage H>the voltage M>the voltage L.

<The First Variation of The Fifth Preferred Embodiment>

Though the case where the writing period AD5 is divided into four has been discussed in the fifth preferred embodiment, a case where the writing period or the all the scanning lines S are divided into three will be discussed in the first variation of the fifth preferred embodiment.

Figure 15:
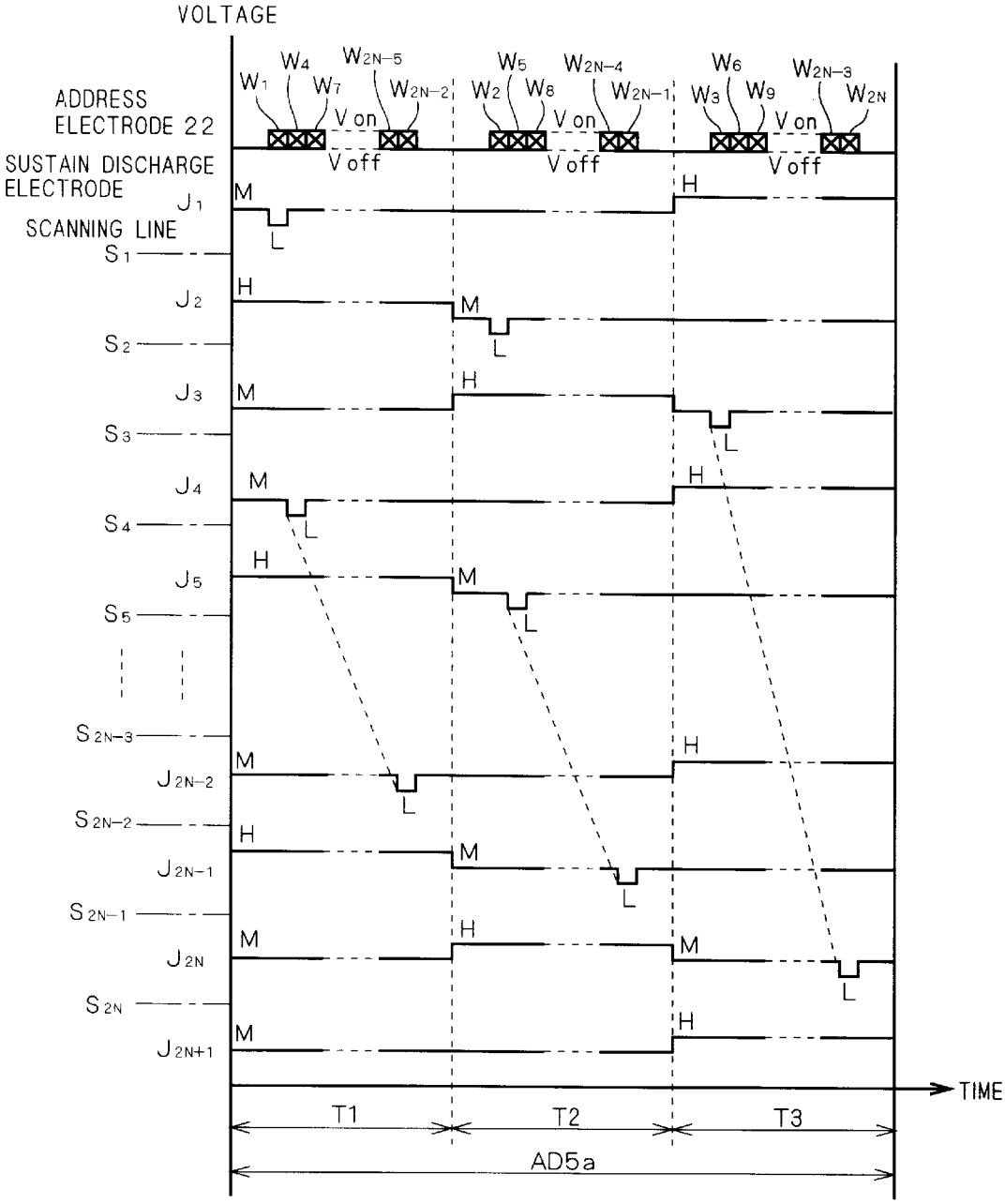
FIG. 15 is a timing chart used for an explanation of a method of driving an AC-type PDP in accordance with a first variation of the fifth preferred embodiment of the present invention.

FIG. 15 is a timing chart used for an explanation of a driving method in accordance with the first variation of the fifth preferred embodiment. Since the above-discussed reset period R and sustain period ST can be used as the reset period and the sustain period in the driving method of the first variation of the fifth preferred embodiment, the reset period and the sustain period are not shown and only the writing period AD5*a* is shown in FIG. 15. Further, the total number 2N of scanning lines S is assumed to be a multiple of three.

In the driving method of the first variation of the fifth preferred embodiment, particularly, the writing period AD5*a* is divided into three writing periods, i.e., T1, T2 and T3. In detail, the writing period T1 is executed on the scanning lines $S_{3t+1}$ ($0 \leqq t \leqq 2N/3-1$), the writing period T2 is executed on the scanning lines $S_{3t+2}$ and the writing period T3 is executed on the scanning lines $S_{3t+3}$. Though discussion will be made herein on an exemplary case where the writing periods T1, T2 and T3 are executed in this order, the order of execution of the writing periods T1, T2 and T3 can be arbitrarily set.

For example, in the writing period T1, at least during the scanning, the voltages at all the sustain discharge electrodes $J_{3t+3}$ are set to the voltage M and the voltages at all the sustain discharge electrodes $J_{3t+2}$ are set to the voltage H. The voltages at the sustain discharge electrodes $J_{3t+1}$ are set to the voltage M before the start of the scanning of the scanning lines $S_{3t+1}$ and the voltages are switched to the voltage L at the timing of application of the image data $W_{3t+1}$ to the address electrode 22. Then, at the end of the application of the image data $W_{3t+1}$ to the address electrode 22 or at the application of the next image data the voltages are returned to the voltage M. Further, the order of selection of the scanning lines can be arbitrarily set only if the image data W to be inputted to the address electrode 22 and the scanning line S to be selected correspond to each other. Furthermore, the sustain discharge electrodes J to which the voltages H and L are applied, respectively, may be changed over.

The same driving sequence is applied to the other writing periods T2 and T3. Specifically, in the writing period Ts (s=1, 2 and 3) for the scanning lines $S_{3t+s}$, the following voltages are applied to the adjacent three sustain discharge electrodes $J_{3t+1}$, $J_{3t+2}$ and $J_{3t+3}$. The voltage M is applied to the sustain discharge electrodes $J_{3t+s+2}$ at least during the scanning. Further, the voltage H is applied to one of the adjacent sustain discharge electrodes defining the scanning lines $S_{3t+s}$, i.e., the sustain discharge electrodes $J_{3t+s+1}$ at least during the scanning. The voltage L is applied to the other of the sustain discharge electrodes J defining the scanning lines $S_{3t+s}$, i.e., sustain discharge electrodes $J_{3t+s}$, only when the scanning lines $S_{3t+3}$ should be selected and the voltage M is applied thereto during the other period. At this time, this application of the voltage L is performed in synchronization with the application of the image data $W_{3t+1}$, to the address electrode 22.

In the driving method of the first variation of the fifth preferred embodiment, the sustain discharge electrode $J_{3t+s+2}$ is not related to the scanning among the adjacent three sustain discharge electrodes in the writing period Ts. In other words, the two sustain discharge electrodes J related to the scanning are each sandwiched by the sustain discharge electrodes J not related to the scanning. Therefore, the driving method of the first variation of the fifth preferred embodiment can also produce the effects of that of the fifth preferred embodiment.

Considering the driving methods of the fifth preferred embodiment and the first variation, the same effects of the fifth preferred embodiment can be produced by the following driving method. Specifically, all the scanning lines S are divided into r ($\leqq 3$) groups so that the scanning lines S belonging to the same group may not be adjacent to one another, and the writing periods B1, B2, . . . , Br for the respective groups are provided. Then, during the scanning of all the scanning lines S belonging to a predetermined group, the voltage H is applied to one of the adjacent sustain discharge electrodes J defining the scanning line S belonging to the group and the voltage M is applied to the sustain discharge electrode J adjacent to the one on the opposite side of the other of the adjacent sustain discharge electrodes J. Further, the voltage L is applied to the other of the adjacent sustain discharge electrodes J when the scanning line S is selected while the voltage M is applied thereto when the scanning line S is not selected. In other words, the one of the adjacent sustain discharge electrodes J is sandwiched by the sustain discharge electrodes to which the voltage M is applied other than when the scanning line S is selected.

<The Sixth Preferred Embodiment>

Figure 16:
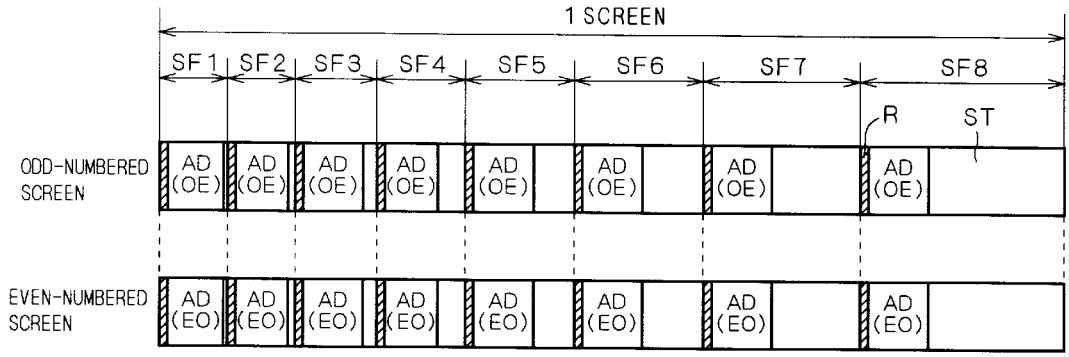
FIG. 16 is a diagram showing a screen formation in accordance with a sixth preferred embodiment of the present invention.

In the sixth preferred embodiment, discussion will be made on a case where a plurality of screens are displayed by the above-discussed driving methods. FIG. 16 is a diagram showing a formation of a plurality of screens in accordance with the sixth preferred embodiment of the present invention. FIG. 16 shows a case where one screen consists of eight sub-fields SF1 to SF8.

Any of the above-discussed writing periods such as the writing period AD1 can be used as the writing period AD shown in FIG. 16. The reference sign OE indicates a case where a writing period O for the odd-numbered scanning lines is executed before a writing period E for the even-numbered scanning lines in the writing period AD (a sub-field having such a writing period AD is referred to as "OE-type sub-field"), and the reference sign EO indicates a case where the writing period E is executed before the writing period O (a sub-field having such a writing period AD is referred to as "EO-type sub-field"). As the writing periods O and E for the odd-numbered and even-numbered scanning lines, the writing periods O1 and E1 for the odd-numbered and even-numbered scanning lines in the writing period AD1 which is used as the writing period AD, or the like can be used.

In the screen formation shown in FIG. 16, particularly, the OE-type sub-field is used in all the sub-field SF1 to SF8 of the odd-numbered screen and conversely, the EO-type sub-field is used in all the sub-field SF1 to SF8 of the even-numbered screen. Therefore, a screen in which the sub-fields SF1 to SF8 are OE-type sub-fields and a screen in which the sub-fields SF1 to SF8 are EO-type sub-fields are alternately arranged. Further, it is obvious that the sub-fields SF1 to SF8 constituting the odd-numbered screen may be the EO-type sub-fields and the sub-fields SF1 to SF8 constituting the even-numbered screen may be the OE-type sub-fields, conversely to the formation of FIG. 16.

With this screen formation, the screen using the OE-type sub-fields and that using the EO-type sub-fields are alternately and equally arranged through a plurality of screens. Therefore, an image display of more stability and higher quality can be achieved as compared with the case where all the screens consists of those using either the OE-type or EO-type sub-field. The reason for this is as follows.

In the OE-type sub-field, for example, the preceding writing period O is executed after all the discharge cells are reset to have no wall charges in the reset period R. In contrast, the following writing period E is executed after the writing operation is performed on predetermined discharge cells belonging to the odd-numbered scanning lines in the preceding writing period O. In other words, the electric field for the writing operation in the following writing period E is affected by the wall charges in the discharge cells in which the writing operation is performed in the preceding writing period O. Thus, it is hard for the preceding writing period O and the following writing period E to have equivalent discharge characteristics. At this time, if all the screens consist of those using the OE-type sub-fields, the display of the even-numbered scanning lines S may be continuously unstable as compared with that of the odd-numbered scanning lines S. In such a case, the quality of the whole display image as a plurality of screens is degraded. Also in a case where all the screens consist of those using the EO-type sub-fields, the same problem arises.

In contrast, according to the screen formation of the sixth preferred embodiment, since the screens using the OE-type sub-fields and those using the EO-type sub-fields are alternately and equally arranged through a plurality of screens as discussed above, it is possible to remarkably suppress degradation in quality of the image display.

In the driving method of the second preferred embodiment (see FIG. 2), the normal wall charges which are reverse in polarity to one another are accumulated on the cathode film 11 above the sustain discharge electrode J shared by adjacent two scanning lines S. For example, the positive charges are accumulated above the sustain discharge electrode $J_2$ on the side of the scanning line $S_1$ or the side of the sustain discharge electrode $J_1$ when the writing operation is performed on the discharge cells belonging to the scanning line $S_1$ in the writing period O2, while the negative charges are accumulated above the sustain discharge electrode $J_2$ on the side of the scanning line $S_2$ or the side of the sustain discharge electrode $J_3$ when the writing operation is performed on the discharge cells belonging to the scanning line $S_2$ in the writing period E2. When the sustain period ST shown in FIG. 2 is executed with this accumulation of charges, the sustain discharge is generated in the scanning line $S_1$ while not generated in the scanning line $S_2$ at application of the first sustain pulse to the sustain discharge electrode $J_2$. Further, with the sustain discharge generated by the first sustain pulse, the wall charges above the sustain discharge electrode $J_2$ on the side of the scanning line $S_1$ are reversed in polarity, becoming negative charges. With this operation, the negative charges are accumulated above the sustain discharge electrode $J_2$ both on the sides of the scanning line $S_1$ and scanning line $S_2$. When the second sustain pulse is applied to the sustain discharge electrodes $J_1$ and $J_3$, the sustain discharges are generated in both the scanning lines $S_1$ and $S_2$. By the following sustain pulses, the sustain discharges are generated in both the scanning lines $S_1$ and $S_2$.

In the even-numbered scanning lines $S_{2n}$ in which the electric charges reverse in polarity to those by the first sustain pulse are accumulated, no sustain discharge is generated even by the first sustain pulse. Therefore, in the even-numbered scanning lines, the number of sustain discharges or surface discharges for one sub-field is smaller by one than that in the odd-numbered scanning lines. The same applies to the driving method of the third preferred embodiment.

On the other hand, in the driving method of the fourth preferred embodiment (see FIG. 9), since the polarity of the normal wall charges accumulated in the preceding writing period O4 is reversed in the polarity reverse period RV, the timing of the starting the sustain discharge is not different between the odd-numbered scanning lines S and the even-numbered scanning lines S. In the polarity reverse period RV, however, since a surface discharge which is the same as the sustain discharge is generated one time in the odd-numbered scanning lines $S_{2n-1}$ selected in the preceding writing period O4, and as a result, the number of sustain discharges or surface discharges for one sub-field in the odd-numbered scanning lines is larger by one than that in the even-numbered scanning lines.

Thus, in some driving methods, the scanning line selected in the preceding writing period and that selected in the following writing period are different from each other in the number of sustain discharges or surface discharges for one sub-field. This difference in the number of sustain discharges is observed as difference in luminescence intensity, i.e., spatial luminance unevenness every other scanning line.

In contrast, according to the screen formation of the sixth preferred embodiment, since the screen using the OE-type sub-fields and that using the EO-type sub-fields are alternately and equally arranged through a plurality of screens as discussed above, the difference in luminescence intensity is compensated on a macro time-scale and it is thereby possible to suppress luminance unevenness every other scanning line.

Figure 17:
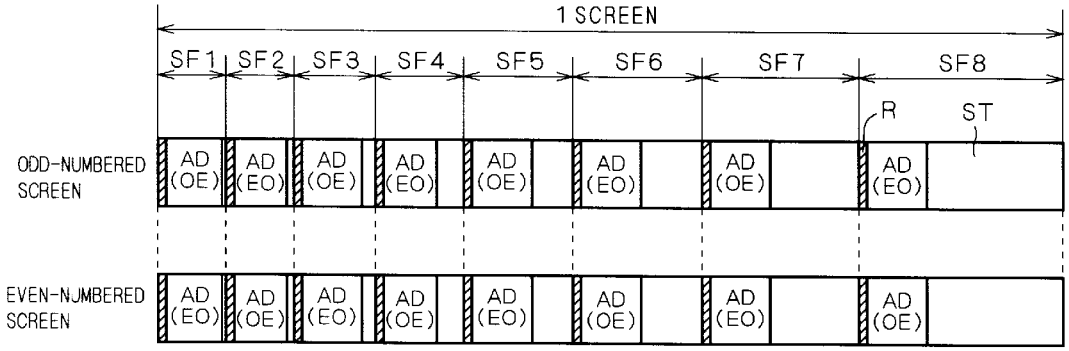
FIG. 17 is a diagram showing another screen formation in accordance with the sixth preferred embodiment of the present invention.

Further, as shown in FIG. 17, a formation in which the OE-type sub-field and the EO-type sub-field are alternately arranged in the continuous two screens, in other words, a formation in which the sub-fields of the same type are not continuous, can produce the same effect.

Considering that the execution order of the writing periods Q1 and Q3 (see FIGS. 11 and 12) or that of the writing period Q2 and Q4 (see FIGS. 13 and 14) may be changed over and the execution of the writing periods T1 to T3 may be arbitrarily set, even the following screen formation can produce the same effect. Specifically, all the scanning lines S are divided into u (≧2) groups and the writing periods B1, . . . , Bu for respective groups are provided, and then the execution order of the writing periods B1, . . . , Bu may be changed every sub-field. In other words, the screen formation in which the order of performing the writing operations on the u groups (i.e., the execution order of the writing periods B1, . . . , Bu) is not determined the same through a plurality of screens may be used.

<The Seventh Preferred Embodiment>

Figure 18:
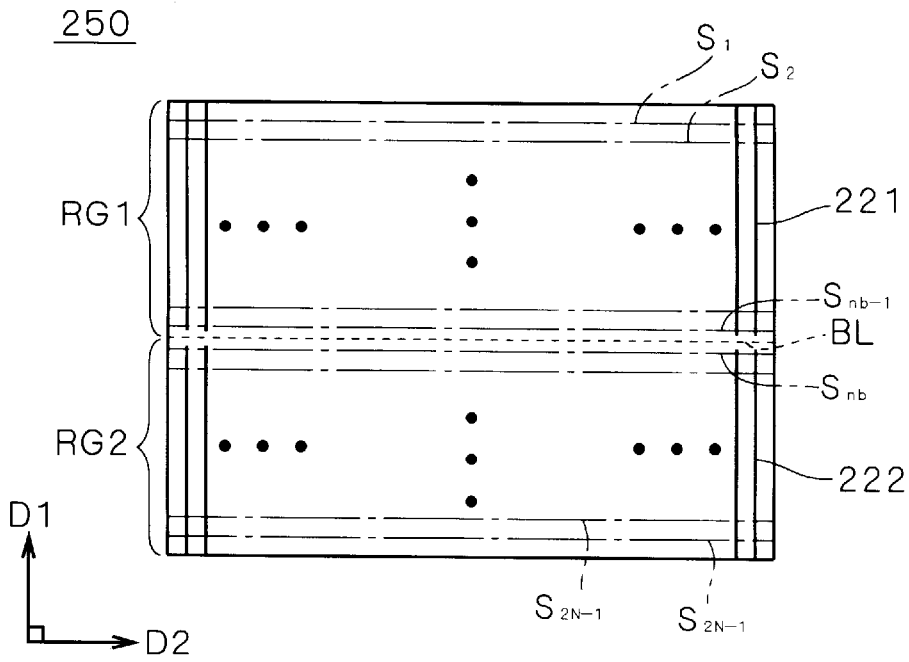
FIG. 18 is a plan view showing a structure of an AC-type PDP in accordance with a seventh preferred embodiment of the present invention.
Figure 19:
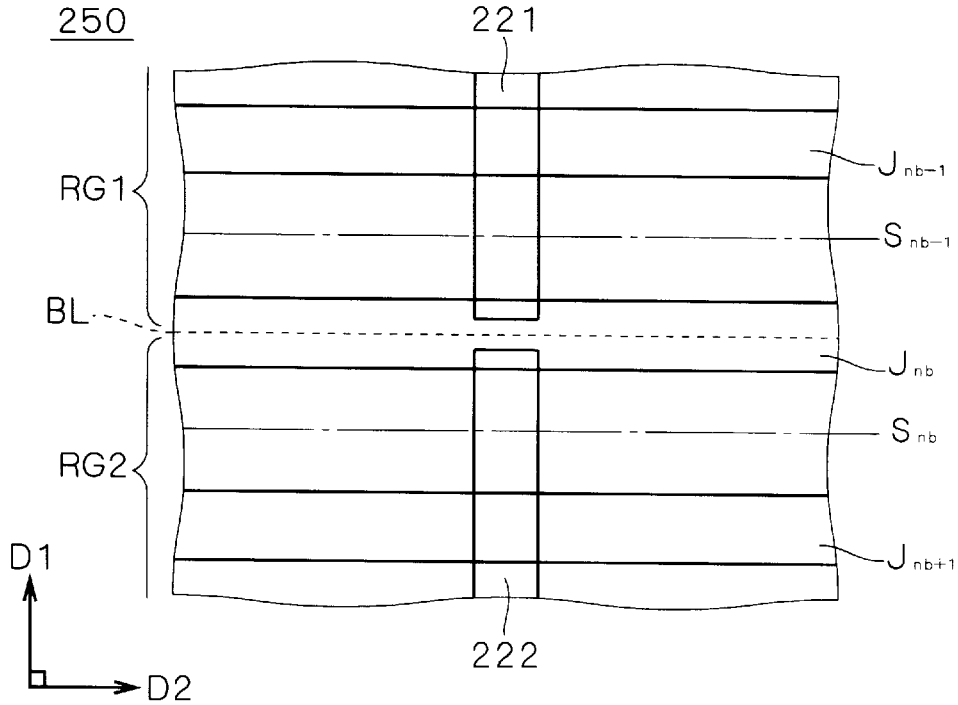
FIG. 19 is an enlarged illustration of principal part of FIG. 18.

As shown in FIG. 20, in the AC-type PDP 200, each address electrode 22 intersects all the sustain discharge electrodes J or all the scanning lines S. In contrast, an AC-type PDP in which the address electrodes 22 are divided into two regions in the first direction D1 or the vertical direction is well known. As one example of such AC-type PDPs, an AC-type PDP 250 is shown in a plan view of FIG. 18, and an enlarged illustration of principal part of FIG. 18 is shown in FIG. 19.

Address electrodes 221 and 222 of the AC-type PDP 250 correspond to a structure in which the address electrode 22 of the AC-type PDP 200 is divided into an upper region RG1 and a lower region RG2 with a boundary BL between adjacent scanning lines $S_{nb-1}$ and $S_{nb}$ (2≦nb≦2N) in parallel with the second direction D2. In detail, the address electrode 221 extending in the first direction D1 intersects the scanning lines $S_1$ to $S_{nb-1}$ belonging to the upper region RG1 and the address electrode 222 extending in the first direction D1 intersects the scanning lines $S_{nb}$ to $S_{2N}$ belonging to the lower region RG2. A plurality of address electrode 221 and a plurality of address electrode 222 are provided along the second direction D2. In this case, the address electrodes 221 and 222 arranged along the first direction D1 correspond to the earlier-discussed address electrode 22. In FIGS. 18 and 19, only constituent elements needed for discussion on the seventh preferred embodiment are shown and other not-shown constituent elements are the same as those of AC-type PDP 200 (see FIG. 20). Further, in general, assuming that nb=N+1, all the scanning lines S are vertically divided into two.

In the AC-type PDP 250, the writing operations in the upper region RG1 and the lower region RG2 can be parallelly performed. According to such a driving method, it is possible to reduce the time for performing the writing operation to the whole AC-type PDP 250, i.e., the time to be spent as the writing period as compared with that of the AC-type PDP 200. As a result, surplus time brought by this time reduction can be used for increased sub-fields and it is thereby possible to achieve higher tone of image. Further, when the number of scanning lines is increased and the surplus time is used for the scanning of the increased scanning lines, an AC-type PDP of higher definition can be achieved.

In the seventh preferred embodiment, discussion will be made on a driving method by which the writing operations are parallelly performed in the regions RG1 and RG2 and the writing operations in the regions RG1 and RG2 are performed in the earlier-discussed writing period AD1 or the like in the AC-type PDP 250.

As shown in FIG. 19, in the AC-type PDP 250, the scanning line $S_{nb-1}$ belonging to the upper region RG1 and the scanning line $S_{nb}$ belonging to the lower region RG2 share the sustain discharge electrode $J_{nb}$. Therefore, there arises problems such as that when the timings of selecting the scanning lines $S_{nb-1}$ and $S_{nb}$ in the region RG1 and RG2, respectively, are different, the state of the accumulated charges in the discharge cell belonging to one of the scanning lines S which is first selected is changed by the voltage applied to the sustain discharge electrode $J_{nb}$ when the other of the scanning lines S is thereafter selected.

Considering this, in the driving method of the seventh preferred embodiment, the timing of applying the voltage to the sustain discharge electrode $J_{nb}$ is set as follows. Specifically, a predetermined voltage is applied to the sustain discharge electrode $J_{nb}$ so that the scanning lines $S_{nb-1}$ and $S_{nb}$ may be selected in synchronization. An exemplary order of selecting the scanning lines in the regions RG1 and RG2 in this driving sequence is shown in Table 1.

TABLE 1

| REGION OF SCANNING LINE | SELECTION ORDER OF SCANNING LINES IN THE PRECEDING WRITING PERIOD | SELECTION ORDER OF SCANNING LINES IN THE FOLLOWING WRITING PERIOD |
|---|---|---|
| REGION RG1 ($S_1$ TO $S_{nb-1}$) | DESCENDING ORDER EVERY OTHER SCANNING LINE nb − 2, nb − 4, nb − 6, . . . | ASCENDING ORDER EVERY OTHER SCANNING LINE . . . , nb − 5, nb − 3, nb − 1 |
| REGION RG2 ($S_{nb}$ TO $S_{2N}$) | ASCENDING ORDER EVERY OTHER SCANNING LINE nb + 1, nb + 3, nb + 5, . . . | DESCENDING ORDER EVERY OTHER SCANNING LINE . . . , nb + 4, nb + 2, nb |

Further, as the driving sequence for the region RG1, for example, the timing chart of FIGS. 1, 4, 6 or the like can be used. All the total number 2N of scanning lines in FIG. 1 or the like correspond to the total number (nb−1) of scanning lines belonging to the region RG1. In the driving method of the seventh preferred embodiment, it is assumed that the sequence of voltages applied to the sustain discharge electrodes $J_{nb}$ to $J_{2N+1}$ belonging to the region RG2 is the same as that of voltages applied to the sustain discharge electrodes $J_{2nb-v}$ (nb≦v≦2N+1) belonging to the region RG1 positioned symmetrically with the sustain discharge electrodes $J_v$ about the sustain discharge electrodes $J_{nb}$.

According to the driving method, in the AC-type PDP 250, the effects produced in the AC-type PDP 200 and effects of reducing the time for the writing period, achieving higher tone image caused thereby and the like can be produced at the same time.

<Note>

Japanese Patent No. 2666711 discloses a driving method in which all the scanning lines in an AC-type PDP are divided into a plurality of groups and writing periods are set for the respective groups. The driving method disclosed in the Gazette, however, is different from the above-discussed driving methods of the first to fifth preferred embodiments in being applied to the AC-type PDP in which adjacent two scanning lines do not share any sustain discharge electrode.

Further, the above Gazette discloses a driving method in which a short sustain period is provided after each of the writing periods for the respective groups. This short sustain period is provided to increase the wall charges generated by the writing discharge and make it easy to shift to a sustain period in the whole AC-type PDP executed later. In contrast, in the driving method of the fourth preferred embodiment (see FIG. 9), the polarity reverse period RV is provided after the preceding writing period O4 to reverse the polarity of the wall charges generated in the writing period O4 and stabilize the operation in the following writing period E4 as discussed earlier. Thus, it is obvious that the polarity reverse period RV and the above short sustain period are different from each other.

While the invention has been shown and described in detail, the foregoing description is in all aspects illustrative and not restrictive. It is therefore understood that numerous modifications and variations can be devised without departing from the scope of the invention.

What is claimed is:

1. A method of driving an AC-type plasma display panel, said AC-type plasma display panel comprising:

a first substrate including a plurality of sustain discharge electrodes extending in parallel with one another, between adjacent two of which each of a plurality of scanning lines is defined, each of said sustain discharge electrodes is shared by adjacent two of said scanning lines, and a dielectric layer covering said sustain discharge electrodes, said dielectric layer having a main surface on which surface discharges are generated, said surface discharges illuminating discharge cells belonging to each of said scanning lines;

a second substrate provided on a side of said main surface of said dielectric layer face to face with said first substrate, said second substrate including a plurality of address electrodes provided in a direction to intersect said sustain discharge electrodes, said address electrodes extending in parallel with one another; and a plurality of barrier ribs provided between said first and second substrates, said surface discharges of said discharge cells belonging to each of said scanning lines being substantially separated by said adjacent two scanning lines, wherein one screen is divided into a plurality of sub-fields, each of said plurality of sub-fields including an addressing period for performing sequentially a selection of said scanning lines by applying scanning-line selection voltages of different values to adjacent two of said sustain discharge electrodes to scan said scanning lines and performing an addressing operation in synchronization with said selection of said scanning lines, in which voltages according to ON/OFF states of image data of a selected scanning line are applied to said address electrodes, to store electric charges in said discharge cell belonging to said address electrode to which said voltage corresponding to said ON state is applied; and a sustain period for performing a discharge sustain operation in which a sustain voltage is applied to said sustain discharge electrodes, to generate said surface discharge in said discharge cell in which said electric charges are stored, and wherein said plurality of scanning lines are divided into a plurality of groups such that adjacent two scanning lines which share a sustain discharge electrode to which a relatively negative scanning-line selection voltage is applied at the time of said selection of said scanning lines belong to different groups, and said addressing operation is performed per said group at respective times in said addressing period, and said discharge sustain operation is performed on all of said discharge cells belonging to said adjacent two scanning lines in said sustain period.

2. The method of driving an AC-type plasma display panel according to claim 1, wherein assuming that one of said sustain discharge electrodes shared by said adjacent two scanning lines is a first sustain discharge electrode, one of said sustain discharge electrodes defining one of said adjacent two scanning lines with said first sustain discharge electrode is a second sustain discharge electrode and one of said sustain discharge electrodes defining the other of said adjacent two scanning lines with said first sustain discharge electrode is a third sustain discharge electrode, a potential difference of said second sustain discharge electrode to said first sustain discharge electrode at selection of said one of said adjacent two scanning lines and a potential difference of said third sustain discharge electrode to said first sustain discharge electrode at selection of said other of said adjacent two scanning lines are made reverse in polarity to each other.

3. The method of driving an AC-type plasma display panel according to claim 1, wherein a discharge inhibition voltage for inhibiting discharges which change storage state of said electric charges is applied to at least one of said two sustain discharge electrodes defining said scanning line when corresponding said scanning line is not selected in said addressing period.

4. The method of driving an AC-type plasma display panel according to claim 3, wherein said scanning-line selection voltage is applied to the other of said two sustain discharge electrodes during a period from the start of said scanning on said group to which corresponding said scanning line belongs to at least the end of said selection of said corresponding scanning lines.

5. The method of driving an AC-type plasma display panel according to claim 4, wherein said scanning lines are divided into said groups so that said scanning lines belonging to the same group are not adjacent to one another, and said discharge inhibition voltage is applied to said sustain discharge electrode defining said scanning line belonging to said group not to be scanned, which is adjacent to the other of said two sustain discharge electrodes, during said scanning on said group to be scanned.

6. The method of driving an AC-type plasma display panel according to claim 5, wherein said scanning-line selection voltage is continuously applied to said other of said two sustain discharge electrodes during said scanning.

7. The method of driving an AC-type plasma display panel according to claim 1, wherein the polarity of said electric charges is reversed in said discharge cells belonging to one of said adjacent two scanning lines, in which said electric charge is generated, and the other of said adjacent two scanning lines is thereafter selected.

8. The method of driving an AC-type plasma display panel according to claim 1, wherein a voltage applied to said sustain discharge electrodes is not changed from the end of said scanning on one of said groups when said scanning on others of said groups starts.

9. The method of driving an AC-type plasma display panel according to claim 1, wherein a voltage applied to said sustain discharge electrodes is not changed from the end of said addressing period when said discharge sustain operation in said sustain period starts.

10. The method of driving an AC-type plasma display panel according to claim 1, wherein the order of execution of said addressing operation in said groups is not the same through a plurality of screens.

11. The method of driving an AC-type plasma display panel according to claim 1, wherein said scanning lines are divided into two regions in a direction of arrangement and each of said address electrodes consists of two electrodes which belongs to said two regions, respectively, being electrically separated in said AC-type plasma display panel, and said scanning lines belonging to each of said regions are divided into a plurality of groups and said addressing operation is performed on a group-by-group basis.

12. The method of driving an AC-type plasma display panel according to claim 11, wherein said selection of two of said scanning lines adjacent to each other with a boundary of said two regions interposed therebetween is performed in synchronization in said addressing period.

13. A plasma display device, comprising:

an AC-type plasma display panel; and a driving device for driving said AC-type plasma display panel, wherein said AC-type plasma panel comprises a first substrate including a plurality of sustain discharge electrodes extending in parallel with one another, between adjacent two of which each of a plurality of scanning lines is defined, each of said sustain discharge electrodes is shared by adjacent two of said scanning lines, and a dielectric layer covering said sustain discharge electrodes, said dielectric layer having a main surface on which surface discharges are generated, said surface discharges illuminating discharge cells belonging to each of said scanning lines;

a second substrate provided on a side of said main surface of said dielectric layer face to face with said first substrate, said second substrate including a plurality of address electrodes provided in a direction to intersect said sustain discharge electrodes, said address electrodes extending in parallel with one another; and a plurality of barrier ribs provided between said first and second substrates, said surface discharges of said discharge cells belonging to each of said scanning lines being substantially separated by said adjacent two scanning lines, wherein said driving device drives said AC-type plasma display panel with one screen divided into a plurality of sub-fields, each of said sub-fields including an addressing period for performing sequentially a selection of said scanning lines by applying scanning-line selection voltages of different values to adjacent two of said sustain discharge electrodes to scan said scanning lines and performing an addressing operation in synchronization with said selection of said scanning lines, in which voltages according to ON/OFF states of image data of a selected scanning line are applied to said address electrodes, to store electric charges in said discharge cell belonging to said address electrode to which said voltage corresponding to ON state is applied; and a sustain period for performing a discharge sustain operation in which a sustain voltage is applied to said sustain discharge electrodes, to generate said surface discharge in said discharge cell in which said electric charges are stored, and wherein said driving device divides said plurality of scanning lines into a plurality of groups such that adjacent two scanning lines which share a sustain discharge electrode to which a relatively negative scanning-line selection voltage is applied at the time of said selection of said selection of said scanning lines belong to different groups, and performs said addressing operation per said group at respective times in said addressing period, and performs said discharge sustain operation on all of said discharge cells belonging to said adjacent two scanning lines in said sustain period.

* * * * *